US008281699B2

(12) United States Patent
Jebsen et al.

(10) Patent No.: US 8,281,699 B2
(45) Date of Patent: Oct. 9, 2012

(54) FIREARM WITH ENHANCED RECOIL AND CONTROL CHARACTERISTICS

(75) Inventors: Jan Henrik Jebsen, Nyon (CH); Renaud Kerbrat, Nyon (CH)

(73) Assignee: Kriss Systems SA, Nyon (CH)

( * ) Notice: Subject to any disclaimer, the term of this patent is extended or adjusted under 35 U.S.C. 154(b) by 0 days.

(21) Appl. No.: 13/210,059

(22) Filed: Aug. 15, 2011

(65) Prior Publication Data

US 2011/0314716 A1 Dec. 29, 2011

Related U.S. Application Data

(63) Continuation of application No. 11/783,380, filed on Apr. 9, 2007, now Pat. No. 7,997,183, which is a continuation of application No. 10/454,780, filed on Jun. 5, 2003, now Pat. No. 7,201,094.

(60) Provisional application No. 60/459,969, filed on Apr. 4, 2003.

(30) Foreign Application Priority Data

Jun. 7, 2002 (CH) ..... 975/02
Jul. 31, 2002 (CH) ..... 1343/02
Apr. 15, 2003 (CH) ..... 679/03

(51) Int. Cl.
*F41A 3/34* (2006.01)

(52) U.S. Cl. ..... 89/24; 89/187.01

(58) Field of Classification Search ..... 89/23, 24, 89/172, 173, 185, 187.01
See application file for complete search history.

(56) References Cited

U.S. PATENT DOCUMENTS

| | | | | |
|---|---|---|---|---|
| 574,189 | A | 12/1896 | Carr | |
| 930,865 | A | 8/1909 | Keith et al. | |
| 1,080,268 | A * | 12/1913 | Dawson et al. | 89/23 |
| 1,452,123 | A | 4/1923 | McCrudden | |
| 1,457,961 | A | 6/1923 | Browning | |
| 1,464,864 | A | 8/1923 | Browning | |
| 1,497,096 | A | 1/1924 | Eriksen | |
| 1,835,715 | A | 12/1931 | McCoy | |
| 2,365,188 | A | 12/1944 | Gorton | |
| 2,476,232 | A | 7/1949 | Williams | |
| 2,555,379 | A * | 6/1951 | Simpson | 89/186 |
| 2,732,768 | A | 1/1956 | Browning | |
| 3,000,268 | A | 9/1961 | Robinson | |

(Continued)

FOREIGN PATENT DOCUMENTS

BE 351672 6/1928

(Continued)

OTHER PUBLICATIONS

International Search Report for PCT/US08/000336, filed Jan. 10, 2008 and Written Opinion dated Oct. 22, 2008.

(Continued)

*Primary Examiner* — Stephen M Johnson
(74) *Attorney, Agent, or Firm* — Wiley Rein LLP

(57) ABSTRACT

The invention comprises an improved recoil control device comprising a bolt head and an inertia block or slider for use in a variety of firearms. In one embodiment, the bolt head and inertia block are articulated so that the displacement of the bolt head results in a force component outside the firing axis of the barrel of the firearm. The device can be incorporated into firearms of a variety of sizes and configurations to produce recoil reduction and/or weight reduction advantages.

11 Claims, 19 Drawing Sheets

U.S. PATENT DOCUMENTS

| | | | |
|---|---|---|---|
| 3,251,270 | A | 5/1966 | Seifried |
| 3,301,712 | A | 1/1967 | Bach |
| 3,489,060 | A | 1/1970 | Marocchi |
| 3,540,141 | A | 11/1970 | Butler |
| 3,554,077 | A | 1/1971 | Schlapia, Jr. |
| 3,564,077 | A | 2/1971 | Schlapia, Jr. |
| 3,568,565 | A | 3/1971 | Swieskowski |
| 3,580,132 | A | 5/1971 | Vartanian |
| 3,641,867 | A | 2/1972 | Junker |
| 3,650,060 | A | 3/1972 | Schubert |
| 3,661,049 | A | 5/1972 | Perrine |
| 3,683,534 | A | 8/1972 | Davis |
| 3,783,739 | A | 1/1974 | Perrine |
| 4,052,926 | A | 10/1977 | Tollinger |
| 4,088,057 | A | 5/1978 | Nasypany |
| 4,112,605 | A | 9/1978 | Staub |
| 4,126,077 | A | 11/1978 | Quesnel |
| 4,164,825 | A | 8/1979 | Hutchison |
| 4,167,890 | A | 9/1979 | Adams |
| 4,172,408 | A | 10/1979 | Ayler et al. |
| 4,183,282 | A | 1/1980 | Perrine |
| 4,279,091 | A | 7/1981 | Edwards |
| 4,301,712 | A | 11/1981 | Cristina |
| 4,369,759 | A | 1/1983 | Gerstenberger et al. |
| 4,373,519 | A | 2/1983 | Errede et al. |
| 4,391,180 | A | 7/1983 | Koine |
| 4,398,116 | A | 8/1983 | Lewis |
| 4,439,943 | A | 4/1984 | Brakhage |
| 4,447,975 | A | 5/1984 | Ljutic |
| 4,492,050 | A | 1/1985 | Kagehiro |
| 4,503,632 | A | 3/1985 | Cuevas |
| 4,506,589 | A | 3/1985 | Junker et al. |
| 4,514,921 | A | 5/1985 | Burkleca |
| H211 | H | 2/1987 | Vanderbeck |
| 4,718,841 | A | 1/1988 | Perrine |
| 4,719,841 | A | 1/1988 | Perrine |
| 4,753,230 | A | 6/1988 | Carus et al. |
| 4,769,937 | A | 9/1988 | Gregory et al. |
| 4,840,107 | A | 6/1989 | Weldon |
| 4,867,038 | A | 9/1989 | Metz |
| 4,910,904 | A | 3/1990 | Rose |
| 4,938,116 | A | 7/1990 | Royster |
| 4,969,880 | A | 11/1990 | Zamierowski |
| 4,974,493 | A | 12/1990 | Yeffman |
| 4,986,018 | A | 1/1991 | McDonald, Jr. |
| 5,031,348 | A | 7/1991 | Carey |
| 5,069,110 | A | 12/1991 | Menck |
| 5,138,931 | A | 8/1992 | Brookshire |
| 5,202,530 | A | 4/1993 | Stephens |
| 5,343,649 | A | 9/1994 | Petrovich |
| 5,445,604 | A | 8/1995 | Lang |
| 5,519,957 | A | 5/1996 | Iannetta |
| 5,520,019 | A | 5/1996 | Schuetz |
| 5,524,374 | A | 6/1996 | Gernstein |
| 5,581,046 | A | 12/1996 | Weldle et al. |
| 5,585,590 | A | 12/1996 | Ducolon |
| 5,596,161 | A | 1/1997 | Sommers |
| 5,614,691 | A | 3/1997 | Taylor |
| 5,669,173 | A | 9/1997 | Rodney, Jr. |
| 5,678,345 | A | 10/1997 | Gnade |
| 5,682,007 | A | 10/1997 | Dobbins |
| 5,722,195 | A | 3/1998 | Bentley et al. |
| 5,758,447 | A | 6/1998 | Venetz |
| 5,782,875 | A | 7/1998 | Ledbetter |
| 5,811,714 | A | 9/1998 | Hull et al. |
| 5,811,720 | A | 9/1998 | Quinnell et al. |
| 5,844,162 | A | 12/1998 | Renner |
| 5,908,693 | A | 6/1999 | Delgado et al. |
| 5,909,002 | A | 6/1999 | Atchisson |
| 5,911,173 | A | 6/1999 | Westrom |
| 5,952,602 | A | 9/1999 | Gussalli Beretta |
| 5,954,679 | A | 9/1999 | Baranitsky |
| 5,979,098 | A | 11/1999 | Griggs |
| 5,983,549 | A | 11/1999 | Battaglia et al. |
| 6,044,748 | A | 4/2000 | Westrom |
| 6,045,942 | A | 4/2000 | Miekka et al. |
| 6,055,760 | A | 5/2000 | Cuson et al. |
| 6,079,138 | A | 6/2000 | Meaker |
| 6,079,311 | A | 6/2000 | O'Quinn et al. |
| 6,196,108 | B1 | 3/2001 | Murello |
| 6,234,058 | B1 | 5/2001 | Morgado |
| 6,243,978 | B1 | 6/2001 | Vignaroli et al. |
| 6,269,727 | B1 | 8/2001 | Nigge |
| 6,305,115 | B1 | 10/2001 | Cook |
| 6,343,536 | B1 | 2/2002 | Rossier et al. |
| 6,357,157 | B1 | 3/2002 | Constant et al. |
| 6,418,833 | B1 | 7/2002 | Hajjar |
| 6,463,336 | B1 | 10/2002 | Mawhinney |
| 6,532,876 | B1 | 3/2003 | Ramirez et al. |
| 6,585,670 | B2 | 7/2003 | Augustine et al. |
| 6,838,589 | B2 | 1/2005 | Liedtke et al. |
| 7,078,582 | B2 | 7/2006 | Stebbings et al. |
| 7,201,094 | B2 | 4/2007 | Jebsen et al. |
| 2002/0053156 | A1 | 5/2002 | McCarthy |
| 2002/0139241 | A1 | 10/2002 | Butler |
| 2003/0051600 | A1 | 3/2003 | Breuer et al. |
| 2003/0056639 | A1 | 3/2003 | Giza |
| 2004/0025680 | A1 | 2/2004 | Jebsen et al. |
| 2004/0069137 | A1 | 4/2004 | Jebsen et al. |
| 2004/0069138 | A1 | 4/2004 | Jebsen et al. |
| 2010/0077643 | A1 | 4/2010 | Kerbrat et al. |

FOREIGN PATENT DOCUMENTS

| | | |
|---|---|---|
| CH | 43050 | 4/1909 |
| DE | 211229 | 6/1909 |
| FR | 969669 | 12/1950 |
| FR | 1193803 | 11/1959 |
| WO | 03104737 A1 | 12/2003 |
| WO | 03104738 A1 | 12/2003 |
| WO | 03104739 A1 | 12/2003 |

OTHER PUBLICATIONS

Mercury Recoil Suppressor from http://www.mercuryrecoil.com.

SPRINCO Recoil Reduction Guide Rods from http://aps.3av.com/about.htm.

Benelli website information from http://www.benelliusa.com.

International Search Report in PCT/CH/03/00362, Oct. 16, 2003.

International Preliminary Report in PCT/CH/03/00362, Aug. 31, 2004.

International Preliminary Report in PCT/CH/03/00363, Jun. 6, 2003.

International Search Report in PCT/CH/03/00363, Oct. 15, 2003.

International Preliminary Examination Report in PCT/CH/03/00364, Aug. 31, 2004.

International Search Report and Written Opinion for PCT/US08/000336, filed Jan. 10, 2008, dated Oct. 22, 2008.

International Search Report on Patentability for PCT/US2008/000336, Filed Jan. 10, 2008. dated Jul. 14, 2009.

* cited by examiner

FIREARM WITH ENHANCED RECOIL AND CONTROL CHARACTERISTICS

RELATED APPLICATIONS

This application is a continuation of U.S. patent application Ser. No. 11/783,380, filed Apr. 9, 2007, now U.S. Pat. No. 7,997,183, which is a continuation of U.S. application Ser. No. 10/454,780, filed Jun. 5, 2003, now U.S. Pat. No. 7,201,094, which claims priority benefit of U.S. Provisional Application No. 60/459,969, filed Apr. 4, 2003, all of which are incorporated herein by reference in their entirety. This application also claims priority to Swiss Application No. 0975/02, filed Jun. 7, 2002, Swiss Application No. 1343/02, filed Jul. 31, 2002, and Swiss Application No. 0679/03, filed Apr. 15, 2003, which are incorporated herein by reference in their entirety.

FIELD OF INVENTION

This invention relates to small and heavy caliber firearms and cannons as well as to improved methods and devices for reducing the consequences of recoil and improving performance in firearms and cannons. In a particular embodiment, the device relates to the control or management of the recoil forces for small caliber semiautomatic or automatic firearms.

BACKGROUND FOR AND INTRODUCTION TO THE INVENTION

Historically, automatic weapons were intended to be loaded mechanically and, therefore, fired much faster than hand-loaded firearms. However, the rapid firing of successive cartridges induces various side effects that proved detrimental both to accuracy and the effectiveness of an automatic weapon. Traditionally, a gun was considered to work like a heat engine, in which about thirty percent of the energy developed by the propellant powder is dissipated as heat, forty percent as muzzle blast and recoil, and only the remaining thirty percent was effectively used to propel the bullet out of the barrel. Successive designs of automatic weapons tried to make use of the vast amount of wasted energy to help make the automatic cycling operate better. Three general systems were used. Hiram Maxim was the first to use recoil forces to mechanize the ejection and loading actions in a machine gun, Browning put the muzzle blast to effective use, and Bergman devised the simple blowback action. Thus, the three basic ways of obtaining an automatic operation were developed from the use of recoil, gas, or blowback actuation. Later applications of the blowback operation used either simple blowback or assisted blowback, with or without locked, delayed, hesitation or retarded blowback, and even blowback with advance primer ignition. Gas operation leads to the use of long and short-stroke pistons and even, in more modern weapons, direct gas action, where the derived gas directly activates a bolt carrier in which an adequate recess is managed. Recoil operation traditionally provided the locking mechanism of the bolt to the barrel so that they can slide together under the thrust of the pressure when firing, either under a short or long recoil operation and with or without muzzle boosters or recoil intensifiers.

Throughout the time these improvements were made a main issue was safety. Depending on the design, operators were susceptible to explosive forces from an improperly chambered round or an incomplete breech lock on the chambered round. Therefore, all systems were engineered in order to secure an accurate locking duration for the breech to the barrel, until the gas pressure falls to a safe level once the projectile has exited the barrel. The main breech locking systems developed employed separate revolving chambers, the rotation of which provides an adequate duration of protection, or toggle systems, rotating bolts, tilting breech blocks, lug systems, or even non-ramming breech blocks. A common but unsatisfactory feature among all these mechanisms is that they do not prevent the undesirable side effects during automatic firing, which accounts for the adverse effects on accuracy and ease of use.

Thus, the mechanisms found on current firearms, although reliable and widely employed, nevertheless suffer from a number of deficiencies. For example, some mechanisms increase the length of the housing of the breech, resulting in interior clutter and increased weight. The amplitude of recoil is relatively critical due to its effect on accuracy, and the existing mechanisms fail to provide a satisfactory or optimum reduction in recoil, which permits the resulting upward movement of the barrel. More particularly, the direction of the recoil forces generally coincides with the longitudinal axis of the gun barrel. The gun barrel is generally located above the shoulder in a person firing a rifle or above the hand in a handgun, and more precisely above the gap between the thumb and index finger of a person firing a handgun. This configuration generates a moment that causes the upward jerking of the gun familiar to every user. Heavy caliber firearms and cannons experience the same upward forces upon firing. For these and other reasons, improvements in the design and operation of small and heavy caliber firearms and cannons are desired in the art.

The innovative approaches taken here make a more effective use of the available energy and, in particular, recycle, as much as practicable, the wasted energy by departing from the traditional and historical mechanisms. In one aspect, this invention provides new solutions, mechanisms, and systems for operating the firing action of a firearm and allows revolutionary changes in the ergonomics applicable to firearm design and use.

Taking into account all these adverse or secondary effects that impede the use of all firearms, and in particular automatic firearms, in which energy is essentially wasted beyond that necessary for propelling the projectile, the present approach is new and innovative. In general and in one aspect, the invention is aimed at addressing the design of a new firearm by taking advantage of available energy to help operate the firearm and consequently minimize and/or compensate for the adverse effects and improve control. A first innovation is the deliberate use and control of energy to address all the adverse effects during operation. This allows one to conceive of a new firearm design and organization, still dependable, but vastly improved. This new approach also allows a firearm designer to address concerns and constraints as part of a whole rather than as individual problems, so as to take into account the advantages and interfaces between firearm components during operation. Considering the operation as a whole, as this invention exemplifies, allows completely new concepts and expands the universe of designs, configurations, and mechanisms possible for firearms.

SUMMARY OF THE INVENTION

The present invention addresses the problems and disadvantages associated with conventional firearms and weapon systems and provides improved devices for reducing recoil effects in a variety of firearms, cannons, and systems. Whether for handguns, rifles, pistols, machine pistols, military rifles, or cannons, one aspect of the invention is to reduce the amplitude or consequences of recoil and/or eliminate, for all practical purposes, the weapon's reactive upward jerking. The invention also facilitates the design and production of a more compact weapon and/or allows substantial reductions in the weight of the frame, which results in many new design possibilities and improvements in ergonomics. Thus, incorporating one or more of the many aspects of the invention into a firearm improves accuracy and/or reduces the total weight.

One of the fundamental principles of the present invention is the transfer of mechanical recoil forces to a direction outside of the longitudinal axis of the gun barrel. As can be seen in each of the exemplary embodiments disclosed herein, the transfer of forces disperses or dissipates recoil forces and thereby reduces the moment responsible for the upward jerking characteristic of conventional firearms. The mechanism that transfers forces can be oriented to counteract the recoil forces along the longitudinal axis of the gun barrel to effectively eliminate or compensate for the upward jerking of the weapon. For example, a pair of inertia blocks of substantially equal mass can be oriented such that their respective movements in response to firing will be synchronized, equal in magnitude, and with corresponding but opposite components of momentum oriented outside the longitudinal axis of the barrel. The net effect is that the opposite movement or displacement of the inertia blocks first absorbs the recoil forces and prevents the weapon from being pushed rearward. Second, the lateral momentum of one moving inertia block cancels the other, thereby inducing no net lateral force or even agitation of the firearm. Thus, the portion of the recoil forces beyond those used to operate the novel mechanisms or system of the invention is transferred in a direction outside the longitudinal axis of the barrel and effectively disposed of by being cancelled out, thereby significantly reducing or even eliminating the component of recoil forces along the longitudinal axis of the barrel that is responsible for the reactive jerking of the weapon when fired. One of skill in the art will recognize that the embodiments disclosed herein are exemplary and that one or more of the foregoing principles can be applied in many variations to firearms of various calibers and applications.

In one particular embodiment of the present invention, a recoil control device for use in a firearm comprises a bolt head configured to alternate between a forward position and a rearward position in response to the firing of one or more cartridges and an inertia block connected to the bolt head such that said bolt head imparts an impulse to the inertia block as it alternates between the forward position and the rearward position. The impulse imparted to the inertia block may have a component lateral or perpendicular to the firing axis of the barrel of the firearm. Alternately, the movement of the inertia block may have a component lateral to or perpendicular to the firing axis of the barrel of the firearm. In either case, the lateral transfer of momentum substantially reduces the reactive recoil forces.

In another particular embodiment, the invention comprises a mobile breech made up of articulated parts including an inertia block and a bolt head. In this embodiment, the action of the mobile breech is unconventional in that it causes the inertia block to alternate out of and into alignment with the longitudinal axis of the barrel. This is contrary to the action of conventional mechanisms in which the parts that compose a mobile breech move in translation along the longitudinal axis of the barrel. The present invention transfers the recoil forces generated by firing to the inertia block, M, by means of a bolt head, m, moving backward at an initial velocity, $v_i$. In a particular aspect of the invention, for example, this transfer of recoil forces from the bolt head to the inertia block is preferably made using corresponding angled surfaces of the bolt head and the inertia block. An impulse transferred to the inertia block translates to a force in a direction other than along the longitudinal axis of the gun barrel thanks first to the configuration of the contact surfaces, and second to the articulated parts connecting to the inertia block, and third the path that guides the movement of the inertia block. The inertia block is thus imparted with a momentum, $Mv_M$, and the velocity vector, $v_M$, has a component parallel to the longitudinal axis of the gun barrel, oriented toward the back or front of the weapon, while the other component is oriented in a lateral direction from the axis of the gun barrel, either below or above the weapon.

Thus, the mobile breech comprises an inertia block that operates to transfer momentum or forces generated by the firing of one or more cartridges or rounds of ammunition to a direction outside of the longitudinal axis of the gun barrel. In a more basic aspect, the inertia block is a component part of a firearm, or more particularly a mobile breech, that moves in response to the force of firing and/or moves in response to the movement of a bolt head. The inertia block or masses allows for the absorption of recoil forces and directs those forces in the form of momentum in a direction outside the longitudinal axis of the barrel. Throughout this disclosure, the use of the term "inertia block" can refer either to a single or to multiple parts or masses. The component masses of the inertia blocks may optionally serve additional functions, such as providing armor protection to or housing components for gun or cannon emplacements equipped with the present invention. Furthermore, the terms "bolt" and "bolt head" are used interchangeably.

In a system where the bolt head absorbs the recoil forces directly through contact with the spent casing of the cartridge, the bolt head is imparted with a rearward momentum along the longitudinal axis of the barrel. When the inertia block moves in response to the movement of the bolt head, the bolt head impulsively strikes the inertia block, either directly or through a linkage, and the momentum of the bolt head is then transferred to the inertia block. The bolt head is typically of significantly smaller mass than the inertia block or blocks. Because of the relative masses of the bolt head and inertia block, the inertia block will move with a different velocity than the bolt head.

An aspect of the present invention is the use of inertia block guides to constrain the movement that the inertia block follows to a direction other than along the longitudinal axis of the barrel, thereby transferring the recoil forces out of the axis of the gun barrel and reducing the reactive jerking described above. Alternately, the initial impulse on the inertia block or blocks may be driven not by direct mechanical connection to the bolt head, but by a gas injection system. In that case, the expanding gases created by the firing of one or more cartridges are used to pressurize a gas injection system and the pressure is selectively applied to the inertia block or blocks to cause their movement in a direction other than along the longitudinal axis of the barrel. In any embodiment, the inertia block or blocks serve the same basic function—to absorb recoil forces and/or re-direct recoil forces out of the longitudinal axis of the barrel.

The path of the inertia block in response to the recoil impulse leaves the longitudinal axis of the gun barrel, thereby translating recoil forces out of this axis. Part of the space occupied by the inertia block during its back and forth trajectory can be located below the axis of the gun barrel, while the rest of the trajectory of the inertia block in its alternating action, as well as the corresponding part of the breech block, can be situated above the barrel axis.

The inertia block can move along a path defined by its guide. The guide can be a slot in a part of the firearm, or can be a rod or articulated part, or any other component designed to allow the inertia block to move back and forth from a loaded position to an end point of its movement. An inertia block guide can be configured so that the movement of the inertia block in response to the impulse can be one of pure translation or the movement can be more complex in nature. In other words, there can be a direct connection possible between the bolt head and the inertia block that causes the movement of the inertia block to move along its guide, or there can be a simple linkage, such as pin rod, or there can be more complex linkages, such as multiple rods and/or articulated parts. The inertia block's movement in turn governs the movement of the bolt head and/or vice versa, due to the manner of their linkage.

In one aspect, a phase displacement can be achieved by engineering the linkage between bolt head and inertia block with a slight play, for example in the longitudinal direction. In another aspect, the phase displacement can be achieved through a delay in the direct contact of the bolt head with the inertia block enabled by the shape or configuration of the contact surfaces. The degree of phase displacement is a matter of design option, but some phase displacement is preferred.

The recoil moment can be further controlled or managed through the positioning of the barrel of the weapon relative to the grip or stock of the weapon. For example, a conventional handgun grip can be placed behind a breech block of the present invention. In certain embodiments of the invention, the axis of the barrel is not found above the grip, as it is conventionally in handguns, but in front of it, typically at mid-height or at two-thirds the height of the grip. Preferably, the gun barrel axis is in line with the forearm of the person aiming the gun and not above it, the effect of which is to eliminate the upward jerking characteristic of the recoil response of conventional guns. However, one can design embodiments of the invention where the barrel can be placed below the grip or stock, above the grip or stock, or at any height relative to the grip or the stock. In combination with the use of one or more inertia blocks, a number of improvements in design, weight, accuracy, and recoil characteristics are possible.

The recoil control device's components can be advantageously prepared with comparatively large parts or large diameter spindles or rods, which simplifies manufacture. This advantage of the present invention greatly improves the reliability in service and the resistance to jamming by sand, mud, and other environmental contaminants and simplifies cleaning and dismantling of the firearm.

The mechanisms and aspects of the invention can be used to complement or improve existing or conventional firearms and can be combined with various arrangements, attachments, and combinations, including without limitation internal release systems, loading systems, ejection systems, gas injection systems, recoil reduction systems, muzzle brakes, sighting systems, tripods, mounting systems, and firing mechanisms.

In one general aspect, the invention comprises an improved and novel recoil control device for use in a firearm, such as a semiautomatic or automatic firearm, in which, for example, a bolt head is configured to alternate between a forward position and a rearward position in response to the firing of one or more cartridges; and an inertia block is connected to the bolt head such that the bolt head imparts an impulse to the inertia block as it alternates between its forward position and its rearward position, the impulse having a component, or force distribution or vectorial force component, lateral to the firing axis of the barrel of the firearm. The force transferred to the inertia block can be in any one of several directions and the inertia block can therefore traverse one of a variety of paths from the impulse imparted through the bolt head, including, but not limited to: a downward sloping, straight path toward the anterior of the firearm; a curved or curvi-linear path; a path extending outward from the barrel; a path moving inward toward the barrel; and a path crossing over the barrel. The path chosen relates to the design characteristics of the firearm desired.

Similarly, the inertia block or mass appropriate for a particular firearm relates to the design characteristics of the firearm. In one embodiment, the inertia block comprises a sloped or angled surface, or a leading sloped surface, that can be contacted by the bolt head to transmit the impulse from tiring. In other embodiments, the inertia block comprises a part or parts that reciprocates between two or more positions and moves in response to the impulse from the bolt head. Multiple inertia blocks can also be used so that they move together in response to the bolt head. In another preferred embodiment, the recoil control device of the present invention can be incorporated into heavy caliber firearm and cannon mechanisms. For example, a heavy caliber rifle, such as a vehicle-mounted rifle or portable rifle of between .50 caliber and 105 mm, or even higher as in a 155 mm cannon, can be produced with an inertia block to translate forces out of the axis of the barrel.

The transfer of the impulse of percussion from the bolt head to the inertia block can be through direct contact between the two parts or through a simple or even a complex linkage. In one embodiment, one or more pin and rod assemblies are used. In another embodiment, a pin connected to the bolt head moves within a slot connected to the inertia block. In other embodiments, one or more reciprocating rods connect the bolt head to the inertia block.

For most firearms of the invention, the inertia block and bolt head are designed to automatically return to their resting or chambered position. A variety of mechanisms can be used to move the bolt head and/or inertia block in the return path. A preferred embodiment employs a spring operably connected to or contacting the inertia block, which can be referred to as the return spring. A variety of spring types can be adapted for this purpose. Alternative return or recovery mechanisms can be designed by one of skill in the art.

The recoil control device can be manifested as in one of the numerous Figures accompanying this disclosure. Also, numerous embodiments and alternatives are disclosed in the accompanying claims. In another aspect, the invention provides a method for making a recoil control device of the invention and/or incorporating into a firearm a recoil control device comprising one or more inertia blocks operably connected to a bolt head, or moving in response to other forces, in order to move in a manner that directs momentum outside of the longitudinal axis of the barrel.

Other embodiments and advantages of the invention are set forth in part in the description that follows, and in part, will be obvious from this description, or may be learned from the practice of the invention.

BRIEF DESCRIPTION OF THE DRAWINGS

For a more complete understanding of the invention and some advantages thereof, reference is now made to the following descriptions taken in connection with the accompanying drawings in which

FIG. 3 also shows a trigger (507) and trigger mechanisms connecting the trigger action to the firing mechanism. In this view, hammer (502) has been cocked, for example, by pulling manual cocking lever (520), and a cartridge is chambered.

FIG. 4 shows a cartridge chambered and the hammer (502) cocked.

FIG. 5 shows the configuration of parts just after firing, where bolt (501) has moved onto secondary sloped surface (512) of slider (510), and slider has begun movement downward.

FIG. 6 shows the configuration of parts at the end (518) of the slider movement downward. The spent cartridge case is ejected.

FIG. 7 shows the slider (707) before firing, positioned above the barrel and in front of the bolt (701).

FIG. 8 shows the slider at the end of its movement and positioned to be returned by return device (708).

FIGS. 12 and 13 show the movement in response to the percussion, where a bolt head and rod act upon the downward sliding inertia block.

FIGS. 13 and 14 show the ejection of the spent cartridge and compression of the return spring as the sliding inertia block moves.

FIG. 15 shows the end of the downward movement of the inertia block.

FIG. 16 shows the reciprocating inertia block returning to the loaded position through the action of the compressed return spring, and where the bolt head catches and begins to chamber a fresh round.

FIG. 17 shows the inertia block and bolt head near its completed return.

FIG. 18 again shows the loaded cartridge and bolt head and inertia block in complete rest or passive attitude.

FIG. 21 shows, in longitudinal cutaway, the loading of a semiautomatic or automatic handgun, as the cartridge is in position to be chambered.

FIG. 22 shows the firearm of FIG. 21 in closed or loaded configuration, a cartridge chambered.

FIG. 23 shows the firearm of FIG. 21 after firing, the bolt head at the beginning of its backward, recoil movement.

FIG. 24 shows the firearm of FIG. 21 with inertia block (slider) at the end of its movement, the spent cartridge being ejected.

FIG. 25 shows the firearm of FIG. 21 during the return movement of the mobile breech and the loading of the next cartridge from the magazine.

FIG. 26 shows the firearm of FIG. 21, with the loading cycle concluded, ready to fire.

FIG. 27 shows, in longitudinal cutaway, a device with a cartridge (D) chambered.

FIG. 28 shows the embodiment of FIG. 27 at the moment of firing.

FIG. 29 shows the embodiment of FIG. 27 at the end of the movement, the spent cartridge case being ejected. The slider surface shown here (208*a*) depicts an additional embodiment, for example, to allow a phase displacement. As explained herein, the surface or surfaces of the slider that contact the bolt or are linked to the movement of the bolt can be selected from a number of angles, shapes, and combinations of angles and shapes.

DETAILED DESCRIPTION OF THE INVENTION

Figure 1:
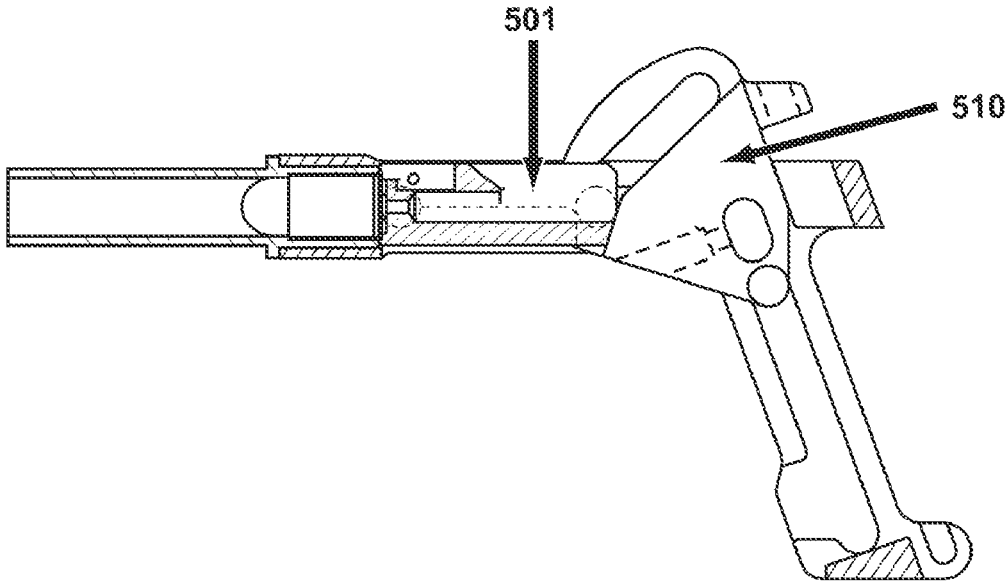
FIG. 1 is a schematic of the mobile breech and the reciprocating operation of a preferred double-angled slider embodiment of the recoil control device according to the invention. The slider (510) and bolt (501) are shown at the chambered or loaded position in FIG. 1.

Whether for handguns or rifles, in other words pistols, machine pistols and assault rifles, the present invention advantageously reduces the consequences of recoil and/or eliminates, for all practical purposes, a weapon's reactive jerking and permits a more compact weapon for a given caliber ammunition.

Where heavy firearms are concerned, for example machine guns and cannons, notably machine guns for land, water craft, or airborne platforms, the present invention enables a lighter frame for the weapon and a more compact and therefore more stowable or containable weapon. This allows moveable weapon systems to store more ammunition per sortie. Further, this invention enables a simplified construction for the base by diminishing the recoil tendency and dampening the stress acting upon the platform as a whole.

In one particular embodiment, the invention comprises a mobile breech made up of connected parts that comprise an inertia block and a bolt head. In this embodiment, the action of the mobile breech is unconventional in that it causes the inertia block to alternate out of and into alignment with the longitudinal axis of the barrel. This is contrary to the action of conventional mechanisms in which the parts making up a mobile breech move in translation along the axis of the barrel. The present invention translates forces generated by the recoil to the inertia block, M, by means of a bolt head, m, moving backward at an initial velocity, $v_i$, in the instant following firing. This transfer of recoil forces from the bolt head to the inertia block is preferably made via contact between corresponding angled surfaces of the bolt head and inertia block. The impulse transferred to the inertia block translates to a force in a direction other than along the axis of the gun barrel. The configuration of the contact surfaces allows the articulated parts to guide the inertia block. The inertia block is thus imparted with a momentum, $MV_M$, and the velocity vector, $v_M$, has a component parallel to the axis of the gun, toward the back of the weapon, and a component perpendicular to the axis of the gun.

Terms such as "under," "over," "in front of," "the back of the gun," or "behind," "anterior," "posterior," "downward," "upward," or "transverse," are used here as somebody firing a gun would understand them, which is by reference to the longitudinal or firing axis of the barrel when the gun is held in the usual horizontal attitude. Furthermore, "firearm" as used here encompasses handguns, pistols, heavy caliber guns, rifles, sniper rifles, guns with automatic and semiautomatic action, mountable and portable cannons, cannons mounted on aircraft or naval vessels, cannons mounted on armored personnel carriers or other armored vehicles, and machine guns or cannons mounted on armored or non-armored vehicles or vessels. Also, a force component perpendicular to or lateral to the longitudinal axis of the barrel refers to a vectorial component or part of a force or momentum vector directed outside the longitudinal axis of the barrel.

Inertia block guides can be configured so that the movement of the inertia block in response to the impulse can be one of pure translation or more complex in nature. The inertia block's movement in turn governs the movement of the bolt head or vice versa, due to the manner of their linkage.

In one aspect, the present invention in particular allows two parameters to be varied: the ratio between the mass of the inertia block and the bolt head, and the angle between movement of the inertia block and the axis of the gun. As discussed more particularly below, the angles formed by parts of the mobile breech can be manipulated to optimize recoil reduction, firing rate, and other operational characteristics in a variety of firearm styles and sizes. Control or variance of such factors is not typical of present firearms technology. The recoil control device notably enables construction of automatic firearms of particular compactness for their caliber.

As shown in the some of the embodiments of the Figures, the trajectory of the inertia block leaves the longitudinal axis of the gun barrel. In one of many optional configurations, part of the space occupied by the inertia block during its back-and-forth trajectory is located below the gun barrel, while the rest of the trajectory described by the inertia block in its alternating action, as well as the corresponding part of the breech block, is situated above the barrel axis.

The positioning of the barrel of the weapon relative to the grip or stock of the weapon can effectively allow one to manage part of the recoil moment. For example, a conventional handgun grip can be placed behind a breech block of the present invention. In one embodiment of this invention, the barrel is not found above the grip, as it is conventionally in handguns, but in front of it, preferably at mid-height or at two-thirds the height of the grip. Preferably, the middle of the gun barrel axis is in line with the middle of the forearm of the person aiming the gun and not above it, the effect of which is to eliminate the upward jerking characteristic of the recoil response of conventional guns. As described in this invention, the placement of the barrel relative to the height of a grip, if a handgrip is used, can vary, but it is preferably placed at about 5% to about 95% of the height of the grip, or about 40% to about 80%, or about 50% to about 70%, or about 60% to about 70%. As stated herein, any particular configuration of the axis of the barrel relative to the grip or stock can be selected.

For semiautomatic or automatic handguns and/or rifles, the present invention preferably uses the handgrip as part of the housing for the inertia block and return device or spring, and this arrangement substantially eliminates the upward jerking of the gun from recoil. However, as shown in the Figures and described here, embodiments of the invention encompass heavy and light machine guns and cannons as well as handguns. Thus, handgrips are not required.

Other characteristics and advantages of the invention will be apparent to those skilled in the art from the description of embodiments designed specifically for handguns and of embodiments designed for heavy automatic weapons and cannons.

Exemplary Small Caliber Firearms and Handguns

The following discussion addresses optional features and design factors one of ordinary skill in the art may employ in producing a smaller caliber firearm. Nothing in this discussion should be taken as a limitation to the scope of the invention and the parameters defined here are merely examples of the many embodiments possible. While the optional features and design factors of the smaller caliber firearm noted here can also be used with heavy caliber firearms, typical firing conditions may make the discussion below more appropriate for smaller caliber firearms.

A variety of configurations can be used to produce a recoil control device in small caliber firearms. As noted above, the preferred embodiment comprises a bolt head operably linked to an inertia block so that the bolt head imparts an impulse to the inertia block upon firing the firearm. In the small caliber embodiment, the inertia block can be referred to as a "slider" since it can be designed and produced as a sliding mechanism that travels in a fixed path. The selection of the weight, shape, and path of the slider will depend on a number of design factors, including, but not necessarily limited to the desired placement of the barrel relative to the handgrip or stock, the part of the frame that is stabilized by a person firing the firearm, or the part of the frame connecting the firearm to a tripod or other support device; the degree of recoil reduction or counteracting of the upward jerking recoil forces desired; the barrel length; the weight of the bolt head; the weight of the firearm; the presence or absence of a muzzle brake; and, of course, the ammunition used in the firearm. One of skill in the art can routinely measure the recoil characteristics of any selected design in order to modify one or more of the design factors noted here to achieve a particular result.

For any particular path for the slider, for example, the weight can be designed to effectively eliminate the upward jerking recoil forces. In a simple and preferred design, a single slider with a slider path is chosen, where the slider path forms a straight line downward from the barrel at a certain angle (referred to as β in FIG. 20, for example) relative to the longitudinal axis of the barrel, in preferred embodiments for a .45 caliber firearm set between 30 and 36 degrees. A second angle (referred to as α in FIG. 19, for example) is formed by the slider path and the sloped surface of the slider that initially contacts the backward-moving bolt or linkage to the bolt. This angle can be varied to select an optimum firing rate of the firearm. In an embodiment of the Figures, an oblique slot is designed to accept a transverse spindle or pin that connects the bolt head to the slider to impulsively transfer the recoil forces in a direction lateral to the longitudinal axis of the barrel. The optimum value for this second angle depends primarily on the caliber of firearm chosen. Angles less than six degrees result in mechanical limitations to the unassisted movement of the slider in reaction to the bolt head. Angles greater than 45 degrees will reduce the effectiveness of the counteracting forces that control the upward jerking movement, but can be selected nonetheless. An angle ranging from about 36 to about 37 degrees allows a firing rate of approximately 900 rounds per minute with .45 caliber ammunition. Preferred ranges of this angle can be selected from about 20 degrees to about 45 degrees. As noted herein, the slider can comprise a double-angle configuration, so that an initial angled surface contacts the bolt or linkage to the bolt, while a second angled surface contacts the bolt or bolt linkage for a majority of the contact area. It is the angle of the initial angled or sloped surface that is used to calculate the angle α (alpha) in the invention. Generally, one will select a higher angle (i.e. an angle closer to a perpendicular line from the gun barrel) of this initial angle of the slider with a high energy round. Some rounds, for example 9 mm rounds, may not use a double-angle configuration in the slider or may use an initial angle that is parallel or close to parallel to the gun barrel in order to generate more speed to transfer recoil energy from the bolt to the slider. The shape of the surface or surfaces of the slider can also vary, so that rounded areas, angled surfaces, or combinations of the two, for example, can be selected, Thus, depending on desired product features, a straight slider path and an unassisted slider movement, a preferred angle can be selected from an angle greater than 6 degrees to an angle of less than about 40 or about 45 degrees. As described below, a double-angled slider with two slopes in the slot of the slider alternatively can be used to allow the designer to vary the rate of fire and to reduce the mass of the slider for a given caliber ammunition. Also, a decreased weight of the bolt can increase firing rate.

Preferably, the slider path is concealed within the body of the firearm in a part or mechanism that can be referred to as a "guide," "receiver," or "path," Whether or not concealed, the guide can be designed so that the slider can be fit into the slider path and linked to the bolt head by hand, to facilitate cleaning and maintenance of the firearm. While not required, a linking part can be used to translate the impulse from the percussion of a chambered round from the bolt head to the slider. A simple pin and/or rod can be used, for example. Preferably, some play in the movement of the slider can be designed in either the selection of the linking part or its connection to the slider or the bolt head. This play can facilitate the rapid removal of spent rounds and/or loading of new rounds. The recoil spring can also be selected for a particular slider weight and rate of fire characteristics desired. One of skill in the art can determine the type of spring configuration or slider return device for a particular embodiment.

Of course, a firearm incorporating or using the devices or methods of the invention can also be combined with any known firearm modification or control devices or systems available. For example, a counterpoise system can be used, a muzzle brake, recoil pads, and gas injection systems can be incorporated into a design, either individually or in any combination. In comparison to alternative or previous recoil control devices, such as the counterpoise or any of a number of spring systems on handguns and rifles, the recoil control mechanism of this invention provide vastly improved characteristics. A direct comparison of the upward movement of the end of the gun barrel after firing a high powered .45 caliber round shows that the firearm incorporating the invention results in very little or no measurable upward movement. This result is also demonstrated by the pattern of rounds into a target in automatic firing, where there is no upward drift when the mechanisms or methods of the invention are used. A conventional firearm displays marked and measurable upward movement of the barrel on firing. Existing recoil control devices can perhaps reduce recoil to a level equivalent to a muzzle brake. The improvement afforded by the devices and methods of the invention are significantly greater. For example, about a 50% reduction in recoil as measured by upward movement of the barrel, or about 50-60% reduction, or about 60-70% reduction, or about 70-80% reduction, or about 80-90% reduction, and even, depending on the design, a 90-100% reduction in upward movement upon firing.

Exemplary Embodiments In The Figures

Having generally described the invention above and the design factors one can consider, what follows refers to specific embodiments of the Figures and Examples, As noted previously, the invention is not limited by the scope of the embodiments listed, the Figures, or the Examples. Rather, one of skill in the art can employ the principles and examples to design, make, and use a number of embodiments not specifically shown here that are fully within the scope of the present invention.

Figure 4:
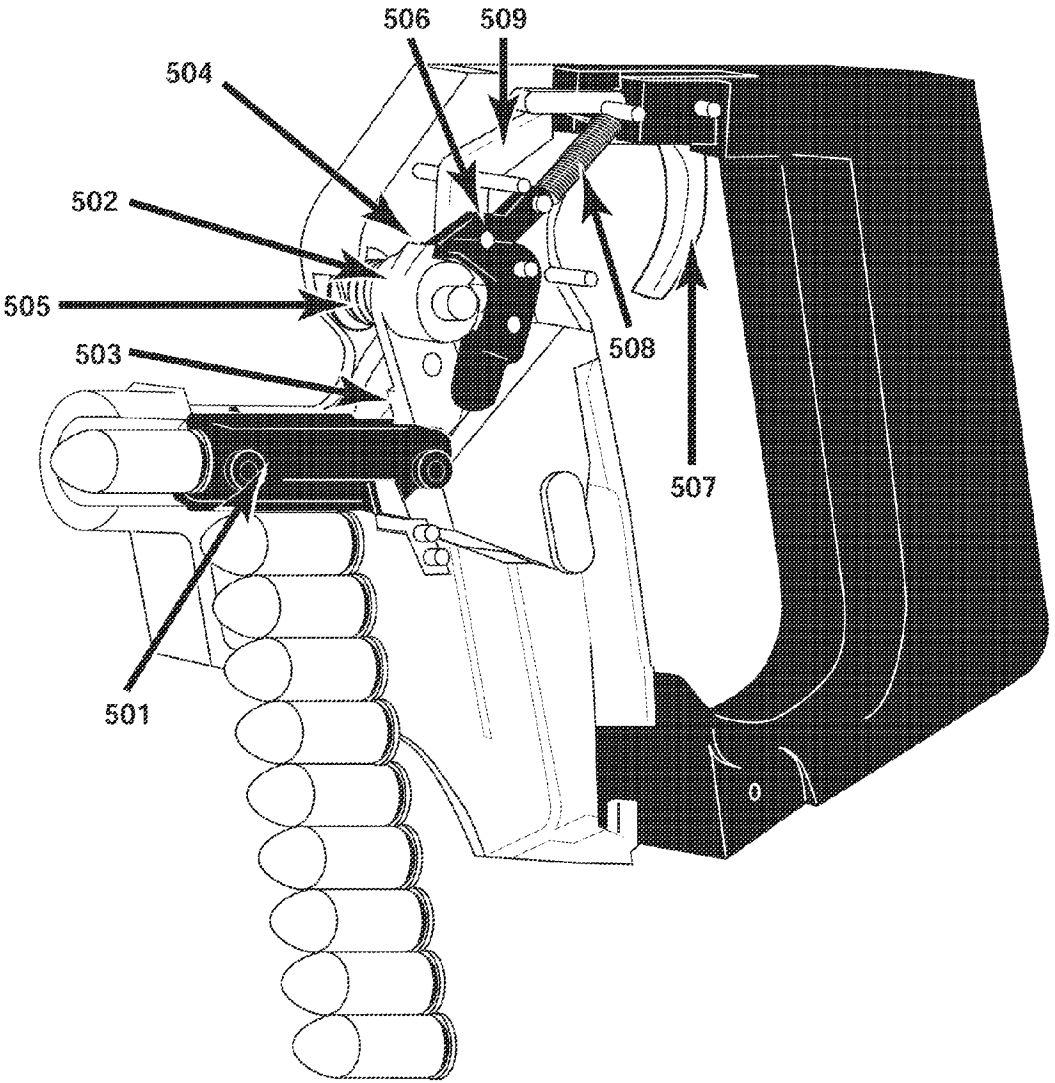
FIGS. 4-6 show a series of cutaway views of the operation of the mobile breech and slider in a handgun or rifle embodiment.
Figure 5:
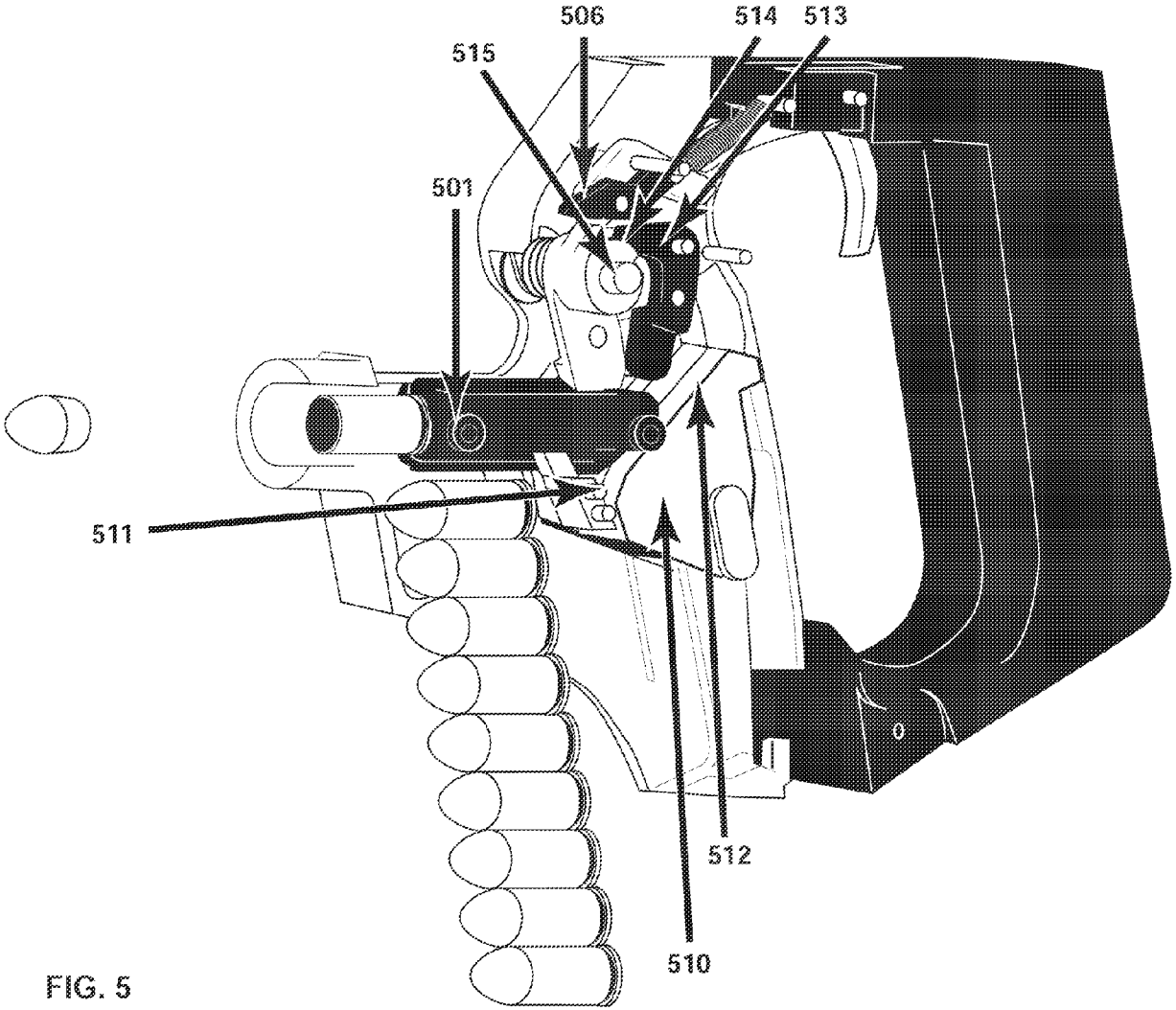
Figure 6:
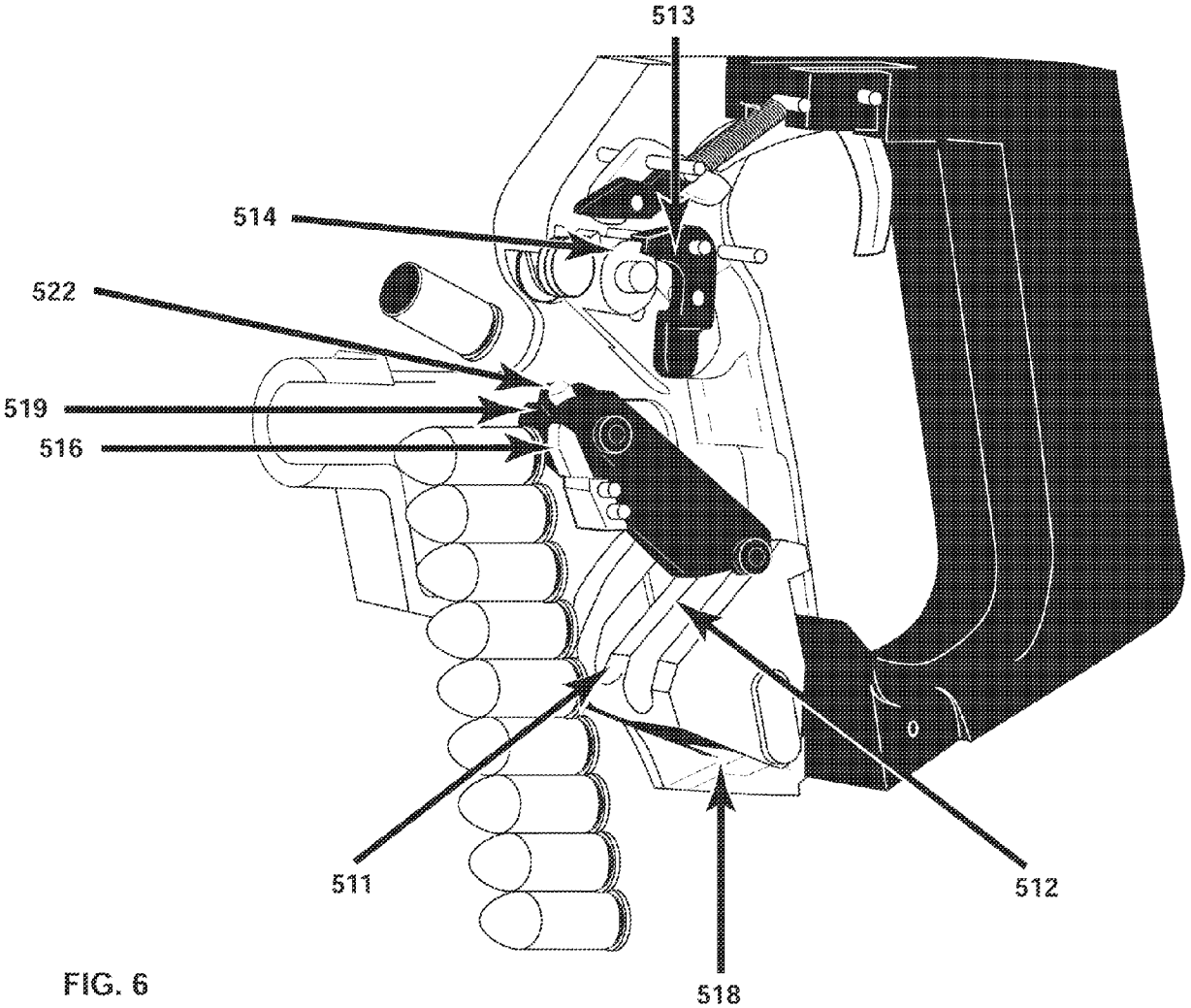

FIGS. 4-6 show a cut-away view of the internal parts and the operation of the system in an exemplary embodiment. In FIG. 4, a cartridge is loaded and chambered in the barrel, with bolt (501) holding the cartridge securely. The bolt is designed to allow the hammer assembly (502) and more particularly the striking surface of the hammer (503) to rotate through a slot to cause the cartridge to fire. At the point shown in FIG. 4, however, the hammer is in a cocked position so that a notch (503) on the axial portion of the hammer is engaged by the cocking lever (506). The hammer spring (505) provides forces to rotate the hammer. Trigger (507), which is held in tension through trigger spring (508), can be pulled to initiate operation of trigger mechanism and firing of cartridge. Pulling trigger (507) forces rocking lever (509) to move, which rotates hammer so that striking surface of hammer (503) is moved further away from cartridge. The cocking lever then rotates and disengages from notch on axial surface of hammer (504). The hammer rotates on axis around its pin (515) allowing striking surface (503) to move through slot on top of bolt to fire chambered round.

FIG. 5 shows the configuration just after firing. The bolt (501), with cartridge case held in place and in contact with bolt, begins movement backward. Initial sloped surface (511) of slider (510) can be seen as bolt moves into contact with second sloped surface (512) of slider. Bolt contacts hammer and causes hammer to rotate around pin (515), now rotating in the opposite direction compared to the firing configuration just described. As end section of holt in contact with slider moves toward backward-most end of slider, slider moves downward along a guide or path. The guide or path can be integrally formed as part of frame of the firearm, or optionally, guide or path can be an internal part of firearm. The hammer contacts separator (513) and separator rotates to engaged position on a second notch (514) on axial surface of hammer. If the trigger remains in pulled position, cocking lever (506) remains up so that it does not engage notch (504). The bolt tilts as it moves back (FIG. 6) so that ejector (516) and extractor (522) displace cartridge case from bolt and the projections on bolt (519). Slider moves downward to redirect recoil forces and counteract upward jerk of barrel. FIG. 6 shows bolt and slider at end of movement (518). Bolt and slider can be formed with one or more projections or tenons that are designed to move along or in paths defining a range of motion. A recoil spring or return device, not shown, forces slider up guide or path. Slider, in connection with bolt, pushes bolt upward and forward to engage next round from magazine. Bolt with engaged cartridge moves into chambered position for firing. Slider surface (512) contacts separator (513) to disengage separator from second notch (514) on axial part of hammer assembly, freeing hammer to again rotate on axis around its pin (515), allowing striking surface (503) to move through slot on top of bolt to fire chambered round.

The operation just described is for automatic action. Semi-automatic, burst firing, and single round action can also be designed using available devices and technology. For semi-automatic action, a second cocking lever, with cocking lever spring, can engage a separate or existing notch on axial surface of hammer to catch hammer before it rotates down to fire cartridge. Thus, after each cycle of the slider and bolt, the second cocking lever for semi-automatic will prevent automatic firing and allow only one round to fire per trigger pull. One of skill in the art can adapt the cocking lever or add an additional cocking lever so that it engages a notch on the axial surface of the hammer after each time the hammer moves backward after firing. The cocking lever used for the semi-automatic action can be connected to a switch on the frame or a switch extending through the frame so that the operator can select between semi-automatic or automatic action. The switch effectively places the appropriate cocking lever in connective position with the notch on the hammer, or allows repeated fixing through the movement of the separator. A burst firing mechanism can also be adapted, as known in the art, so that a certain number of rounds are fired automatically.

Additional safety options can also be implemented, as known in the art. For example, the handgrip and trigger, or handgrip and part of the trigger mechanism, can be designed to separate from the frame in order to prevent firing of the firearm. The handgrip and trigger components can further be equipped with personal security devices so that only designated users can assemble or operate the firearm.

Figure 3:
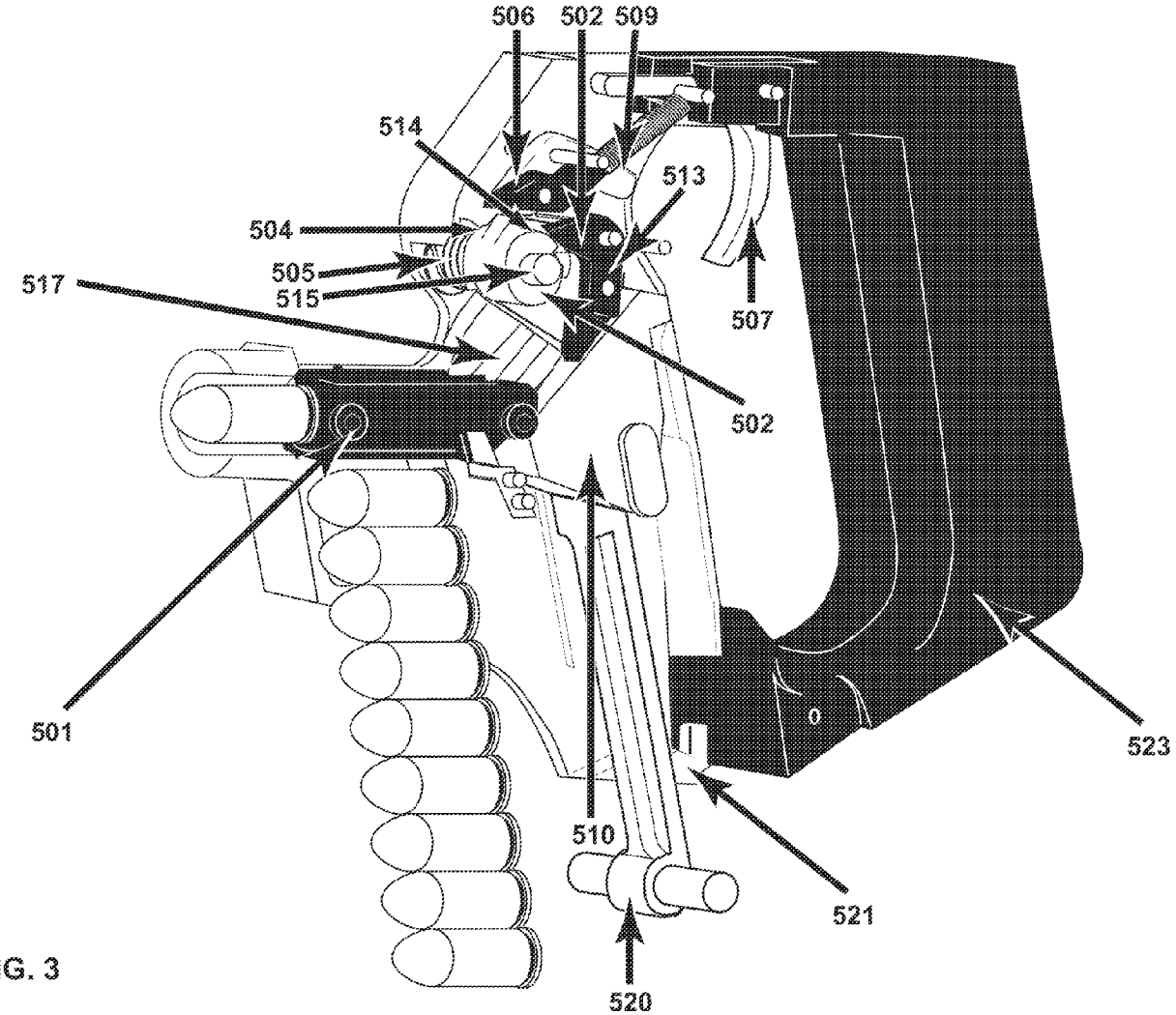
FIG. 3 shows a cutaway view of a semi-automatic or automatic handgun equipped with a slider similar to that shown in the embodiment of FIG. 1.

FIG. 3 shows a cutaway view of the same embodiment of FIGS. 4-6, except that an optional manual cocking lever (520) extends through the bottom of the frame. In the position shown in FIG. 3, the separator (513) is engaged in the second notch on axial surface of hammer (512), and the slider (510) is in position to contact separator from below to disengage it from notch (514) and release hammer (502) so that striking surface of hammer can fire cartridge. At top of handgrip (523) optional pins for connecting and quickly removing handgrip and part of trigger mechanism can be seen. Here, slider is linked to bolt (501) through pin (not shown) extending through slot (517) in slider.

Figure 2:
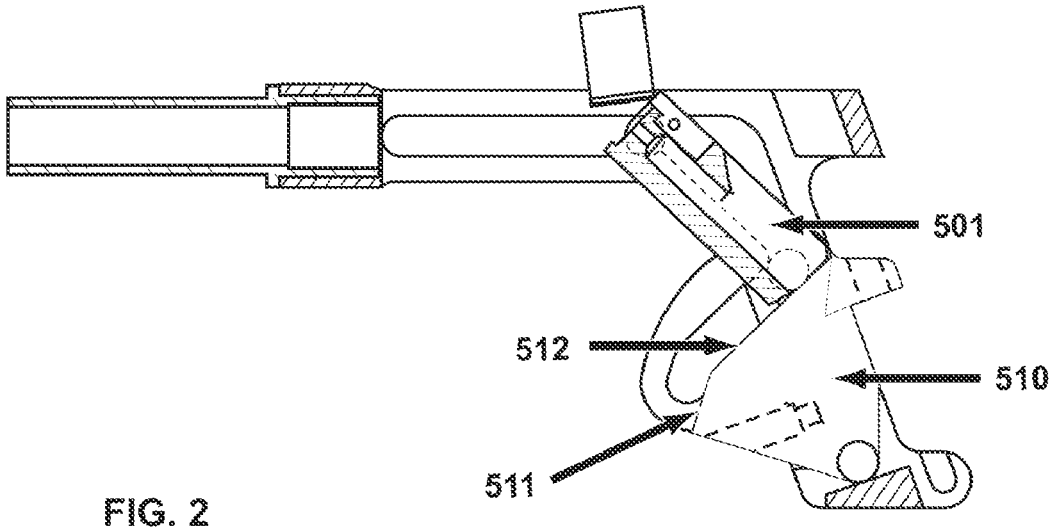
FIG. 2 shows a schematic as in FIG. 1, after the cartridge has fired and the bolt (501) and slider (510) have moved backward and downward. The cartridge case can be seen being ejected from the bolt head. The initial angle (511) or first sloped surface of the slider can be seen in this double-angled slider configuration, where sloped surface (512) makes up the remaining part of the slider surface in contact with bolt (501) or bolt linkage device. The bolt or an integral part of the bolt may contact the slider surfaces, or a linkage part or combination of linkage parts, such as rods and pins, may contact the slider surface.

FIGS. 1-2 show schematically a double-angled slider (510) and its movement in a receiver of guide. Bolt (501) is linked to slider and initial surface of slider (511) and second sloped surface of slider (512) are visible. In FIG. 2, the spent cartridge case is being ejected from bolt head.

Figure 7:
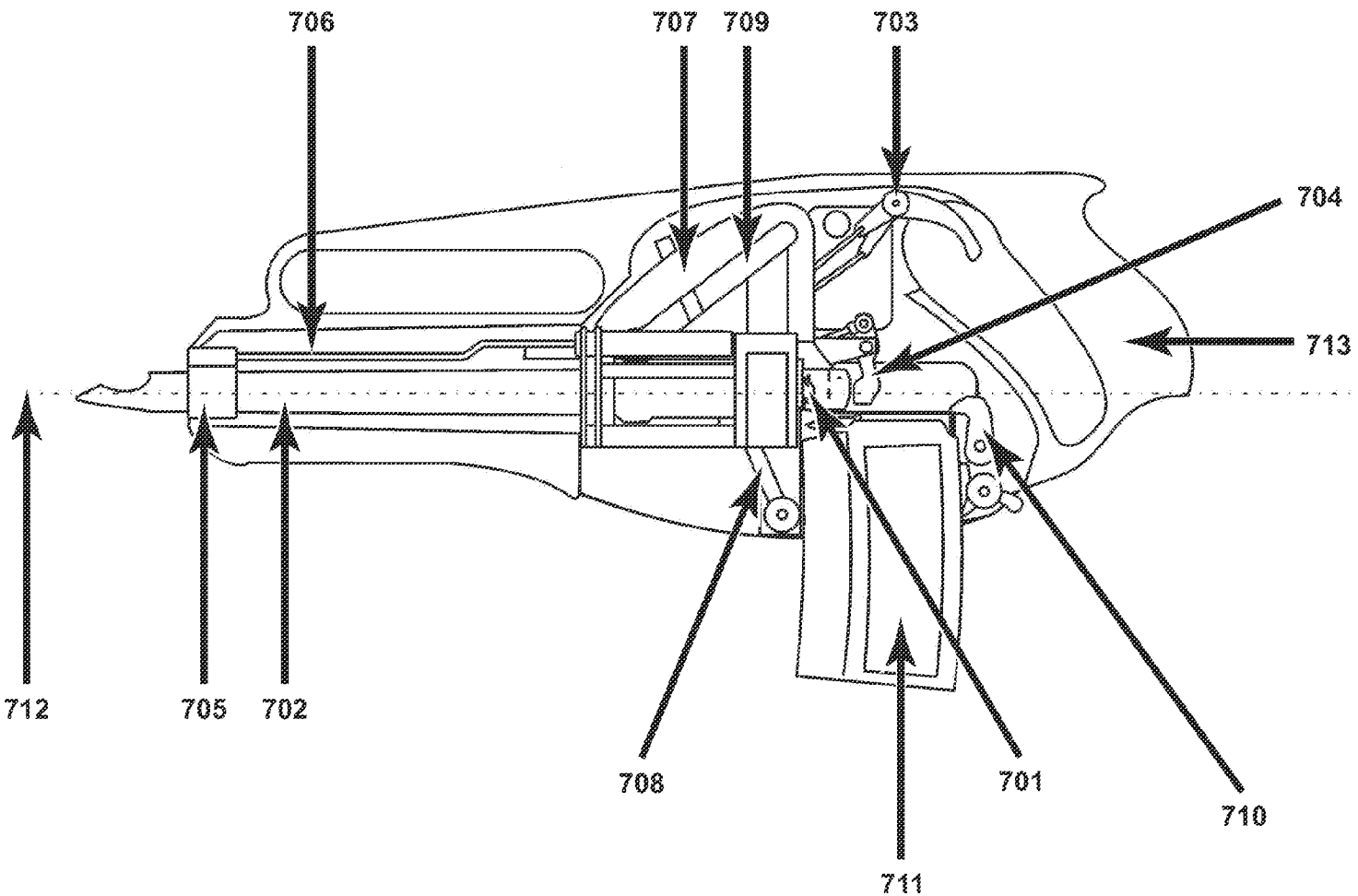
FIGS. 7-8 show a cutaway view of an alternative embodiment, where a slider is placed above the barrel and slides downward from a position in front of and to the side of the breech.
Figure 8:
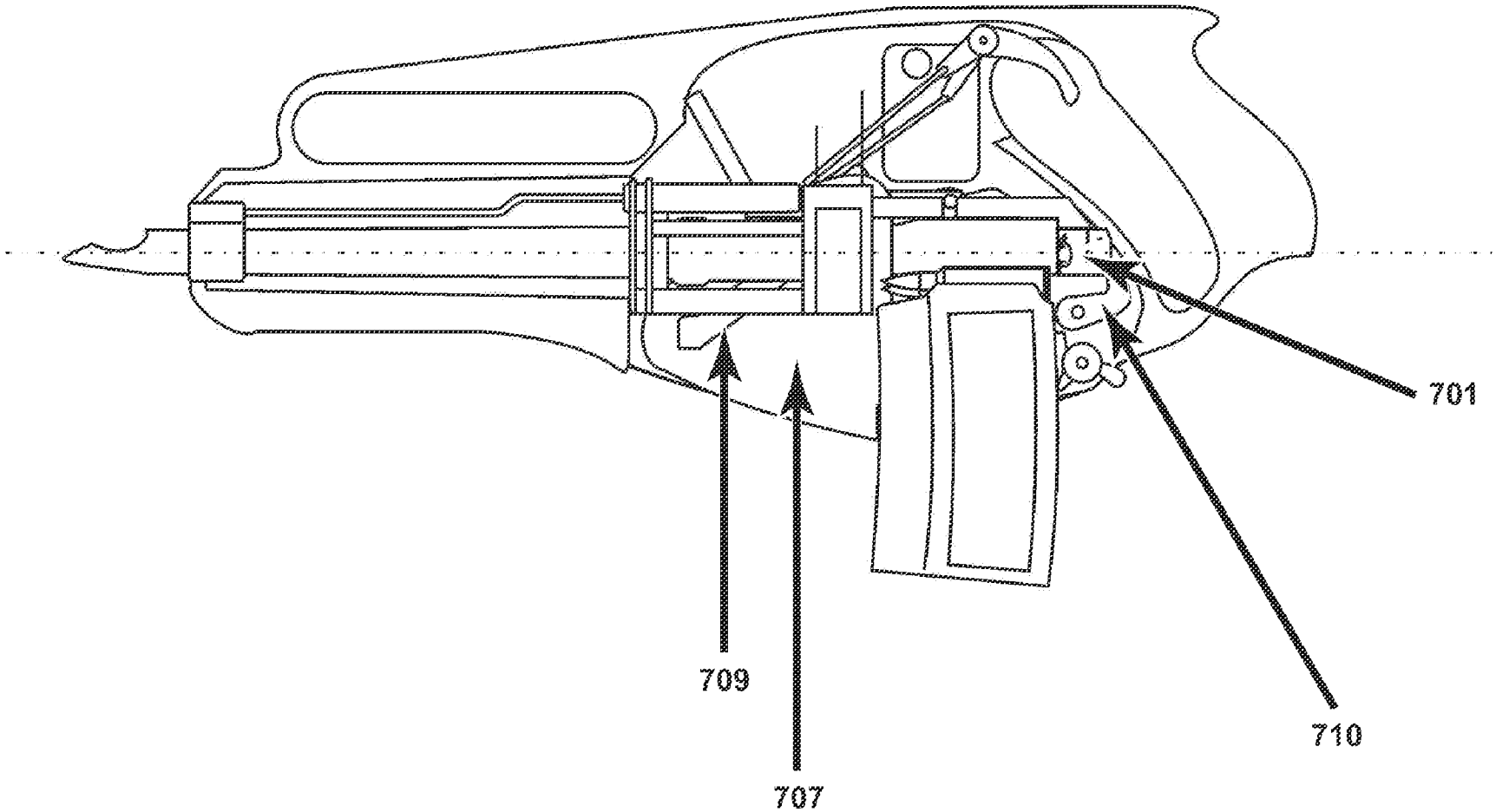

While the embodiment of FIGS. 1-5 can be used for a handgun, the same mechanisms can be adapted for a rifle. Additional options can be incorporated to either the handgun or rifle. In one example, which can be suitable for .308 caliber ammunition, a gas injection system can be incorporated. Further, as shown in FIGS. 7-8, the slider can be positioned in other areas of the firearm. FIGS. 7-8 show a slider positioned above the barrel and in front of the bolt. In FIG. 7, bolt (701) is in loaded position at chambering end of barrel (702). A trigger mechanism (703) causes hammer (704) to fire cartridge. The gas injection system (705) forces pressurized air through tube (706), which initiates movement of bolt (701) back and slider (707) down path defined by return device (708). Typically, a spring is used as the return device. Movement of the slider down its path redirects recoil forces and virtually eliminates upward jerking of the barrel upon firing. Slot (709) in slider connects with initial gas impulse transferring mechanism (not shown). Either a single-angled or double-angled slider can be selected, or indeed, a multiple-angled slider or slider with multiple shapes on its surface. Here, a single-angled slider is shown in FIG. 8 and the lower end of slot (709). In FIG. 8, the slider (707) has moved to its downward-most position. Feeding lock (710) releases next round from magazine (711), which can be chambered by bolt (701). As in FIGS. 1-5, the firing action can be single-shot, semi-automatic, burst firing, or fully automatic. In addition, with this and other embodiments herein, an electronic or other non-mechanical firing mechanism can be used.

Figure 32:
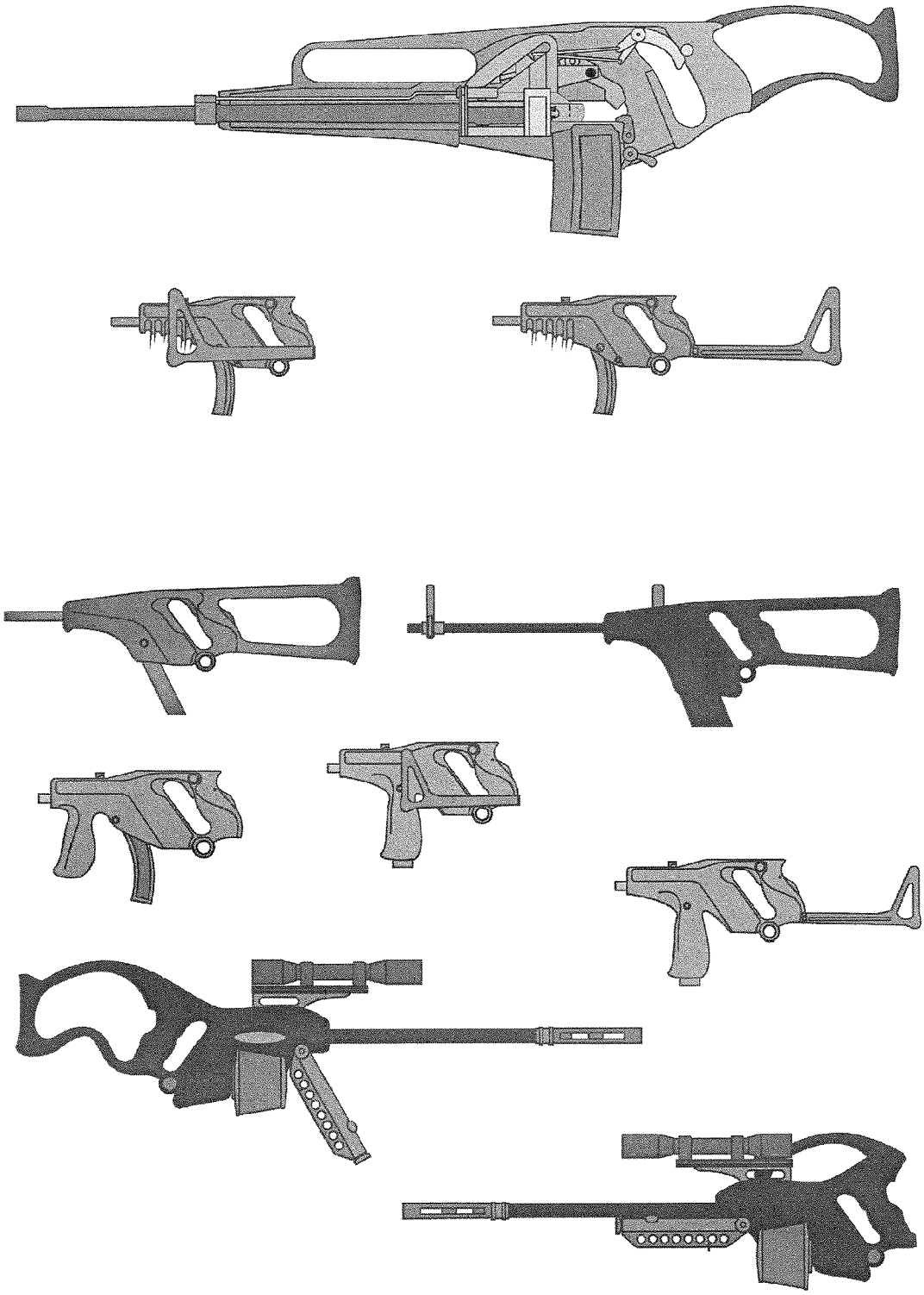
FIG. 32 shows a number of design alternatives in the configuration of a small caliber firearm incorporating the invention. These variations show, inter alia, the options in placing the handgrip relative to the middle of the axis of the barrel and the design freedoms allowed by the compact and reliable operation of a firearm of the invention. In one embodiment, the inertia block, with slot for connecting to or linking to the bolt head, is seen above the barrel of the firearm

As shown in FIGS. 7-8, the placement of the handgrip (713) relative to the middle of the axis of the gun barrel (712) can take advantage of reduced interior clutter the new recoil devices allow. For handguns in particular, the handgrip is positioned below the middle of the axis of the barrel. This exacerbates recoil effects and adds to the reactive upward jerking upon firing. In firearms of the invention, as shown for example in FIGS. 7 and 8, the handgrip can be positioned at a point where the middle of the axis of the barrel intersects a line at approximately 70% of the height of the handgrip relative to the Lop of the handgrip. In the embodiment of FIGS. 1-6, the middle of the axis of the barrel intersects the handgrip at approximately 50% of the height of the handgrip. The range of possible positions for the handgrip relative to the middle of the axis of the barrel can vary by design factors or by the desired recoil control characteristics. In a preferred embodiment, the handgrip is positioned so that the axis of the gun barrel is in line with the middle of the wrist, or positioned at a line formed by the middle of the arm through the middle of the wrist of the operator holding the handgrip. Alternatively, the middle of the axis of the barrel can intersect the handgrip at a range of positions, for example from about 10 to about 30% of the height relative to the top, from about 30 to about 50% of the height, from about 50 to about 70% of the height, from about 70 to about 90% of the height, or about 5 to about 95% of the height. In fact, the middle of the axis of the barrel can even be below or above the handgrip. In addition, other parts of the frame can be modified to allow both hands to grip the firearm. FIG. 32 shows a number of examples.

FIG. 1 is a schematic of the mobile breech and the reciprocating operation of a preferred double-angled slider embodiment of the recoil control device according to the invention. In FIG. 2 the slider is at the lowest end of its cycle and the bolt head is at the back-most end of its cycle. FIG. 1 shows the same slider embodiment at its closed position, where the slider is at it upper end of its cycle and the bolt head is furthest forward.

In FIGS. 1-29, the mobile breech comprises bolt head and inertia block. As noted above, in a handgun or other embodiment of the invention, the inertia block can be referred to as a sliding mechanism or a "slider" and these terms are used interchangeably. The slider can take various forms, for example a trapezoid, but many other forms and shapes are possible. The slider is articulated with the bolt head close to its rear extremity, optionally by a transverse spindle, which can take the form of a machined tenon or pin on the bolt head projecting on either side. The bolt head can have a second tenon or pin, also projecting on both sides, in its foremost section that engages a guidance ramp to guide the cyclic path of bolt head. In this preferred embodiment, the performance of a semi-automatic or automatic firearm can be improved by using a double-angled slider, characterized by an oblique slot (517 in FIG. 3), comprising two sloped surfaces (511 and 512 of FIG. 6 or FIG. 2). The length of each sloped surface can vary. The forward-most sloped surface engages the bolt head or bolt head articulation mechanism when the round is chambered and/or when the bolt head is locked, so that the bolt head is prevented from moving backward (the configuration of FIGS. 1 and 4, for example). While not required, the double-angled slider can perform more reliably in preventing the bolt head from moving than a slider having a single sloped surface. Also shown in FIGS. 3-8 is a trigger mechanism in operating linkage to the hammer, which strikes the cartridge on the bolt or the cartridge contacting the bolt. Conventional mechanisms can be adapted for use with the invention or in designing a firearm.

As shown in the figures, it is preferred to use large parts and integrated pins and receiving slots so that assembly, cleaning, and maintenance characteristics are improved. However, other operating or triggering mechanisms can be used with a firearm of the invention. One of ordinary skill in the art is familiar with the selection and use of a variety of triggering mechanisms for a variety of ammunition sizes and types, including those that can accommodate multiple sizes of ammunition.

The action of the mobile breech and bolt head can be controlled within its movement to appropriately chamber and eject successive rounds. As shown in the FIGS. 4-6 and 11-18, for example, the bolt head tilts relative to the barrel. At a point near or at the end of its backward and downward movement, the spent round is ejected using conventional ejector and extractor devices. As the magazine pushes the next round toward the barrel, here the magazine pushes upward but other directions can be selected depending on the placement of the magazine with respect to the barrel, the forward moving bolt head catches the end of the cartridge and inserts the round into the chamber.

In FIGS. 7-8, a configuration designed preferably for a .308 caliber or 7.62 NATO round is shown. The slider (707) here is positioned above and forward of the bolt head (701), and the cycle action takes the slider through a downward and upward trajectory. The slider and bolt head articulating mechanisms are located above the bolt head to conserve space for a magazine below the barrel. However, optional design configurations can also include slider and bolt head articulating mechanisms below the bolt head, to allow for magazines on the top of the barrel or above or to the side of the barrel, In the embodiment of FIGS. 7-8, a safety clip or feeding lock (710) is optionally included to prevent loading or firing of rounds at other than the desired time. The safety clip (710) moves in response to the cartridge and clips the top edge of each cartridge. These Figures also show a triggering mechanism. As before, the layout and design of the triggering mechanism can be selected from many available options and one of ordinary skill can devise an appropriate or preferred triggering mechanism. FIG. 7 shows the round chambered and locked, with the slider (707) at its utmost position. After firing, the slider moves to its fully displaced position (FIG. 8), partially or largely below the barrel. The slot (709) for connecting the slider to the bolt head can be seen in both Figures. In FIG. 8, the optional double-angled surface of the slider is visible.

Figure 19:
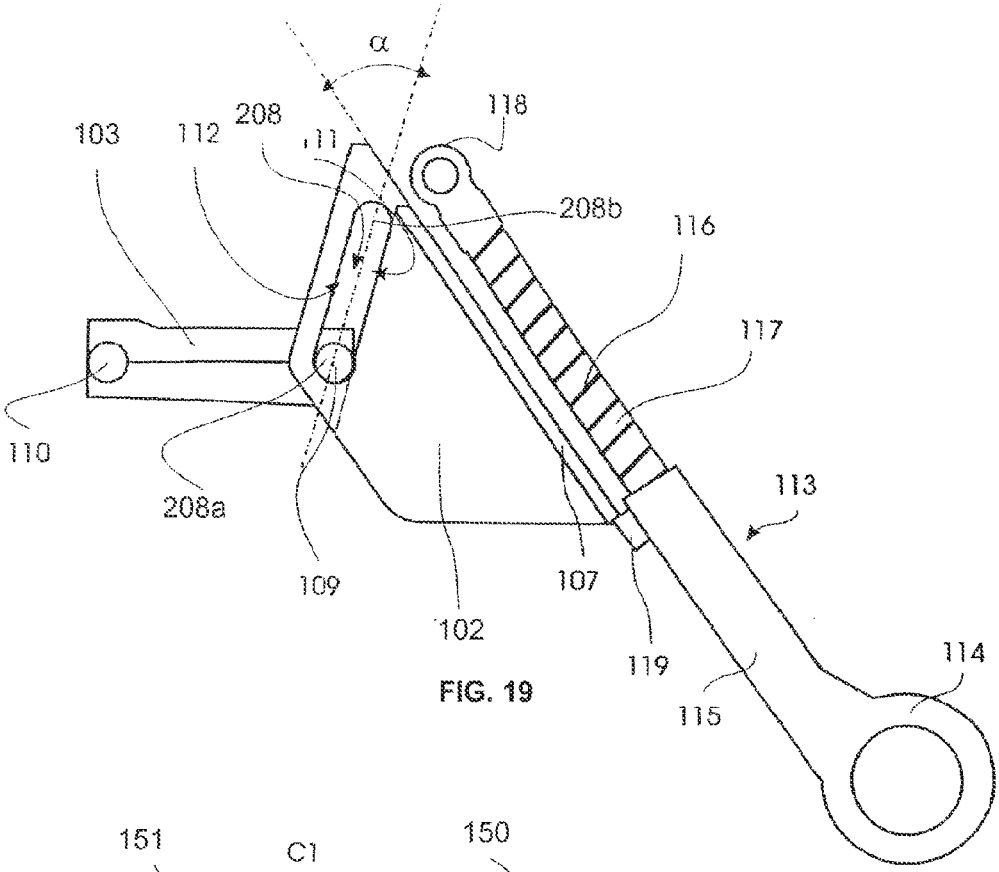
FIG. 19 is a schematic of the mobile breech and the reciprocating operation of a preferred single-angled slider embodiment of the recoil control device according to the invention.

In a preferred embodiment, the performance of a semi-automatic or automatic firearm can be improved by using a double-angled slider. As shown in FIGS. 3-6, the rear edge of slider (510) has a pair of lateral flanges extending from either side of the slider and positioned to slide in the guidance grooves of the guide or receiver. The guidance grooves have a slope relative to the axis of the barrel, which presents an angle ($\beta$), shown in FIG. 20, and preferably set between 30 and 36. In FIG. 19, the slope of the parts shown presents an angle ($\alpha$), the variance of which changes the firing rate of the firearm. The angle ($\alpha$) preferably is between 24 and 36 degrees. For a .45 caliber embodiment, an angle ($\alpha$) of about 36 to about 37 degrees allows a firing rate of approximately 900 rounds per minute. An angle ($\alpha$) of approximately 32.5 degrees can correspond to a firing rate of approximately 2000 rounds per minute. There is a practical minimum value for angle ($\alpha$) below which mechanical blockage occurs and little or no articulation is possible. This minimum angle is a function of the power of the ammunition used, and is approximately 6 degrees for the standard .45 ACP ammunition of the Examples below. The use of two slopes in the slot or surface of the slider allows the designer to vary the rate of fire, to reduce or alter the mass of the slider, or reduce or alter the mass of the bolt for a given caliber ammunition.

Figure 9:
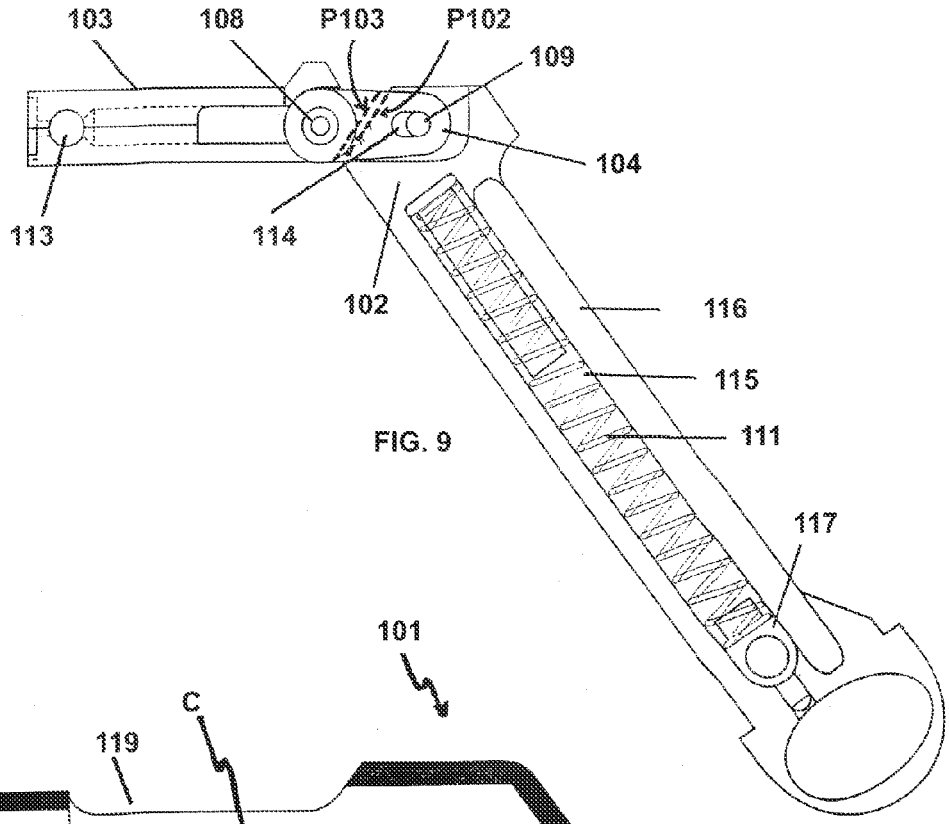
FIG. 9 shows the mobile breech for another preferred embodiment of the recoil control device, with an alternative type of action.

FIG. 9 shows the mobile breech, which consists of bolt head (103), pin rod (104) and inertia block (102). The pin rod (104) preferably is joined to the bolt head (103) close to its rear extremity by means of a transverse spindle (108) projecting on both sides of bolt head (103). The front of the bolt head preferably has a transverse stud or linking-pin (113) also projecting on both sides of bolt head (103). The pin rod (104) preferably is articulated in proximity to its second end by a transverse stud or spindle (109) with the forward part of the inertia block (102). The transverse stud (109) engages a longitudinal groove (114) in the pin rod (104). FIG. 9 shows the mobile breech in extension, with transverse stud (109) in the back of groove (114). The bolt head (103) and the inertia block (102) may or may not be in contact. Inertia block (102) and bolt head (103) present complementary sloping contact surfaces (P102 and P103, respectively), which preferably are separated somewhat by some minor play engendered by groove (114). When stud (109) slides in groove (114), the surfaces of the bolt head and the inertia block make contact at their sloped ridges, (P102 and P103), which are parallel.

The inertia block (102) is generally cylindrical and oblong in form. In the back is a recess (115) in which is fitted a reset spring (111). The tip of the spring bears a part (117), which slides at compression and links with the bolt housing. The inertia block has longitudinal flanges (116) on either side designed to fit the housing's guidance slots.

Figure 10:
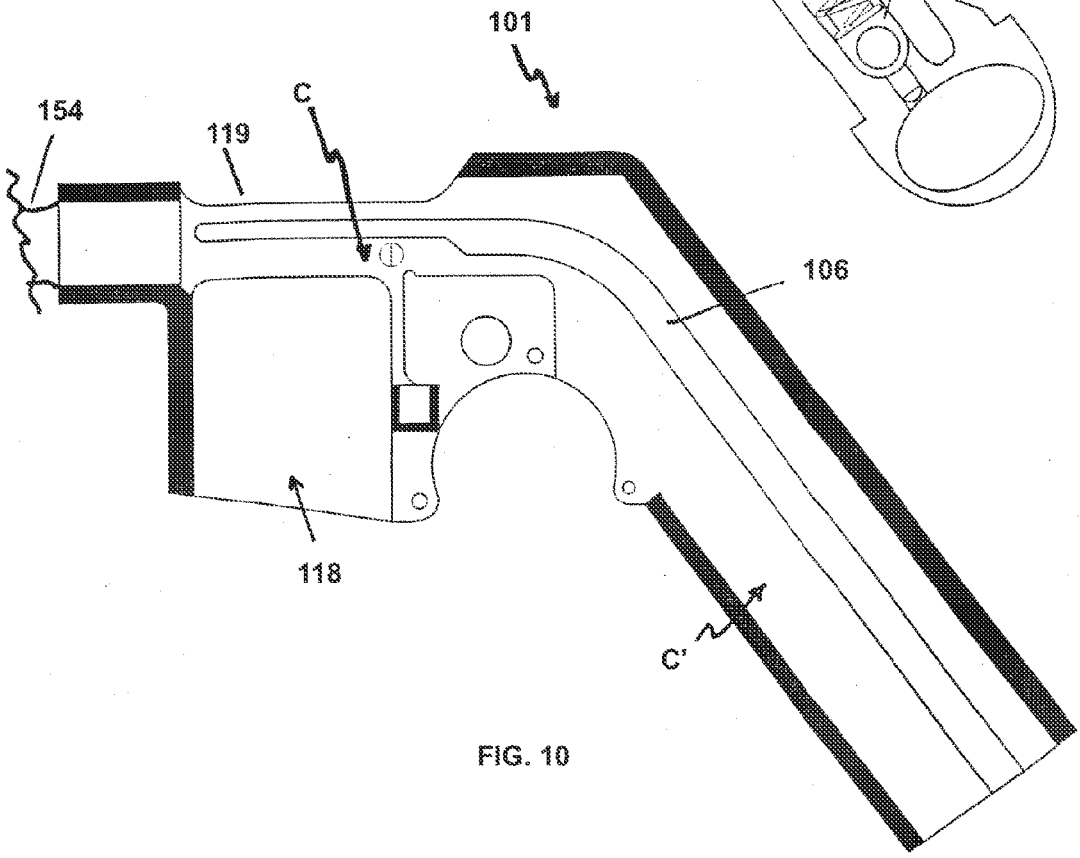
FIG. 10 shows a longitudinal cutaway of the housing for the embodiment of FIG. 9.

This mechanism fits within the breech housing (120) shown in cutaway in FIG. 10, the general "V" form of which creates a cavity also in "V" shape, with two arms, C and $C_1$. The breech housing at its forward extremity supports the gun barrel (154) and receptacles for a magazine underneath (118). It has an ejection slot (119) situated in the top of this embodiment. Alternately, the slot could be located laterally without prejudice to the performance of the mechanism.

As illustrated in FIG. 10, each side of the casing preferably has a guidance ramp (106) in "V" shape in the form of a groove accommodating the respective projections of the spindles (108 and 109) articulating the bolt head (103), with the pin rod (104) and with the inertia block (102), as well as the extremities of stud (113) and flange (116). The head of the V of the ramp is rounded.

FIGS. 11 to 18 show the movement of a pistol equipped with a moment control mechanism similar to that shown in FIGS. 9 and 10. The trigger, percussion and ejection mechanisms are not shown to simplify the drawing. To the extent not described herein, triggering, percussion, and ejection may be accomplished by conventional methods well known to those skilled in the art.

Figure 11:
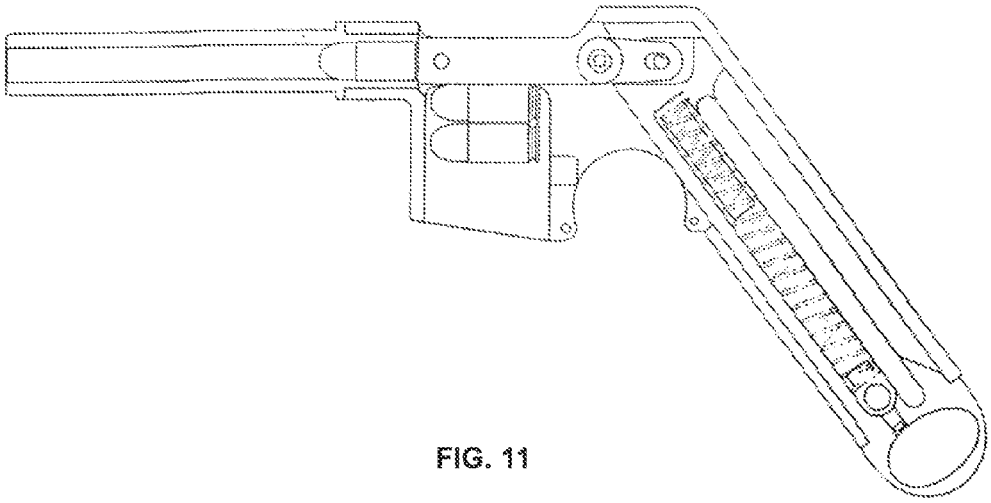
FIGS. 11-18 show the functioning of the embodiment of FIG. 9.

FIG. 11 shows the embodiment of FIG. 9 with bolt closed. A round is chambered. The bolt head (103) is in its position preceding percussion. The trigger has been pressed and the cartridge is on the point of being struck. Note that the mobile breech is extended with the transverse spindle (109) linking inertia block (102) and pin rod (104) in the back of the oblong slot that houses it. However, in this angular configuration, the bolt head (103) and the inertia block (102) are separated only by a very slight play.

Figure 12:
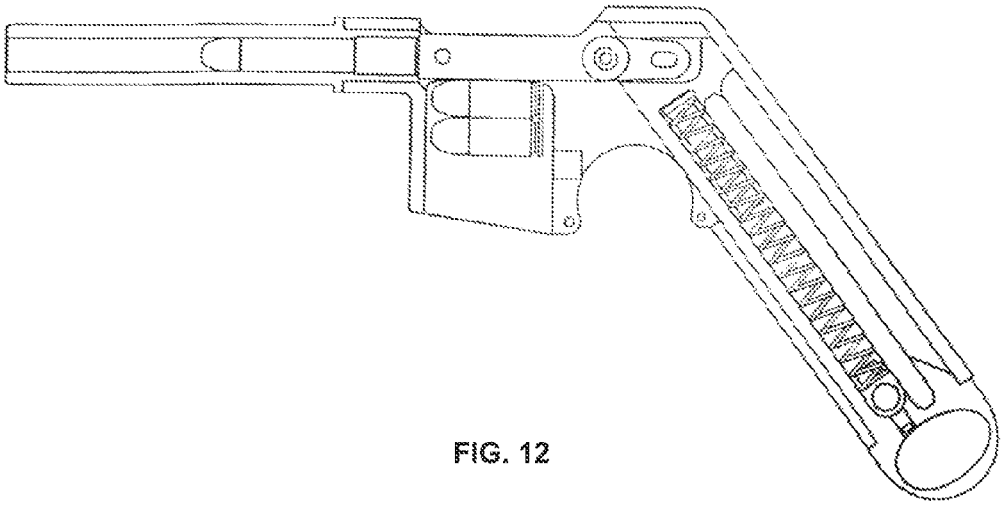
Figure 13:
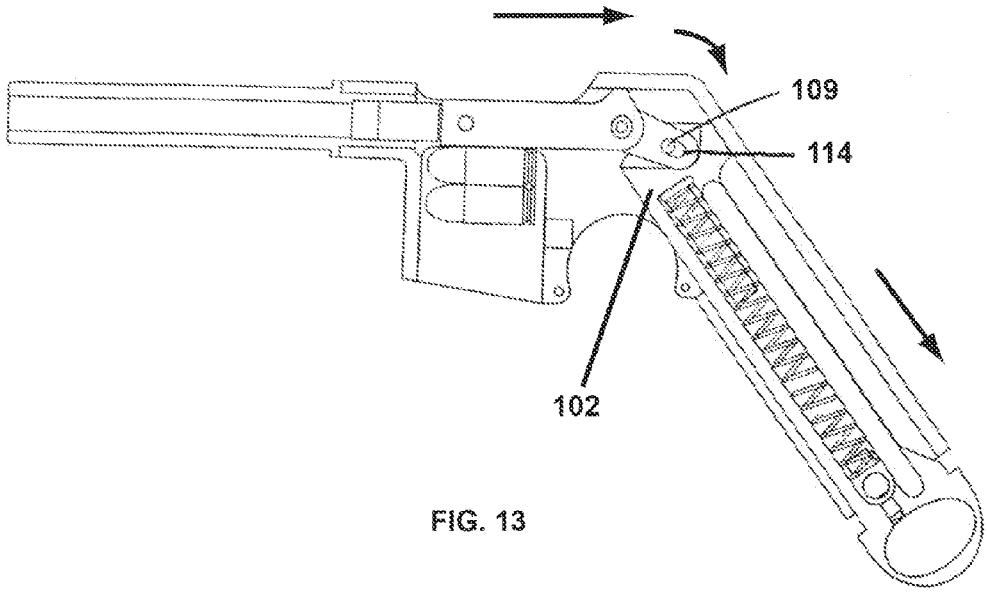

In FIG. 12, the cartridge has been struck, the round has left the gun and the spent case moves back and pushes against the bolt head (103). In turn, the bolt head (103) moves backward along the axis of the barrel and strikes the inertia block (102), which rapidly translates from its initial forward position to its aft most position in the butt of the gun as shown in FIGS. 10-12. In FIG. 13, the first movement of the bolt head (103) is a translation backwards and the movement of the inertia block (102) is a slanted translation towards the lower sector of the gun, while the trajectory of the pin rod (104), guided by the top of the "V" of the ramp, is deflected around the curve of the V. At this stage, the spindle (109) slides in groove (114). The pin rod (104) exerts no force on the inertia block (102) and does not pull on the bolt head (103). The extensions of transverse spindles (108 and 109) constrain the movement of the spindles to follow the curved path of guidance ramp (106).

The slopes P102 and P103 initially slide against each other, imparting an impulse from pin rod (104) to inertia block (102), then separate.

Figure 14:
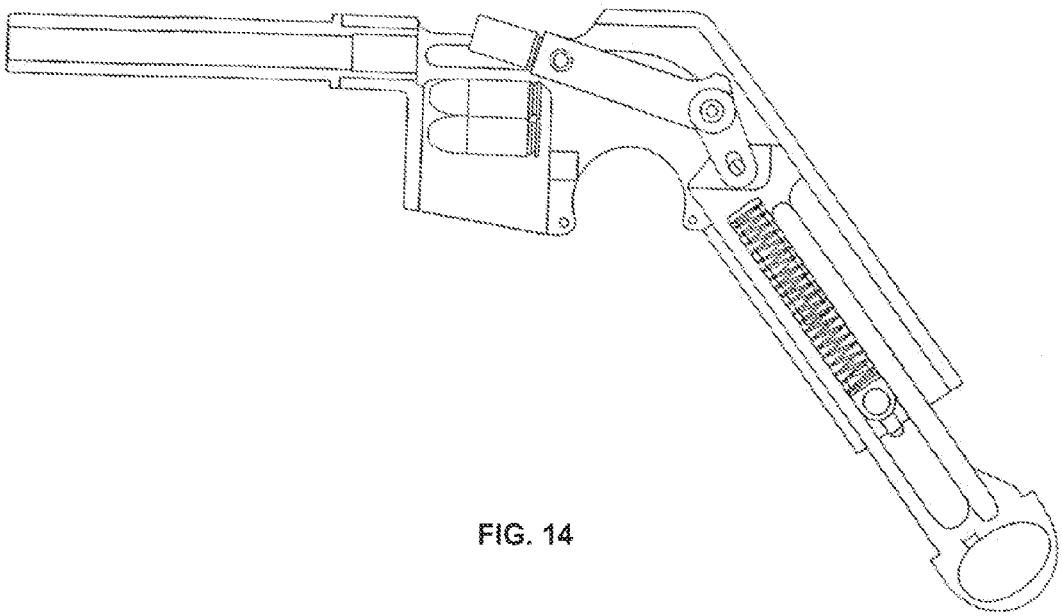

In FIG. 14, the inertia block (102) is continuing its translation downward. It pulls on the pin rod (104) and the bolt head (103). The mobile breech is extended. The spent case is forced backward by the ejection mechanism in familiar technique.

As the mobile breech continues its displacement in extension, the spindles (108) and (109) go over the rounded "V" of the guidance ramp (106) and the trajectory of the bolt head (103) is deflected downward.

Figure 15:
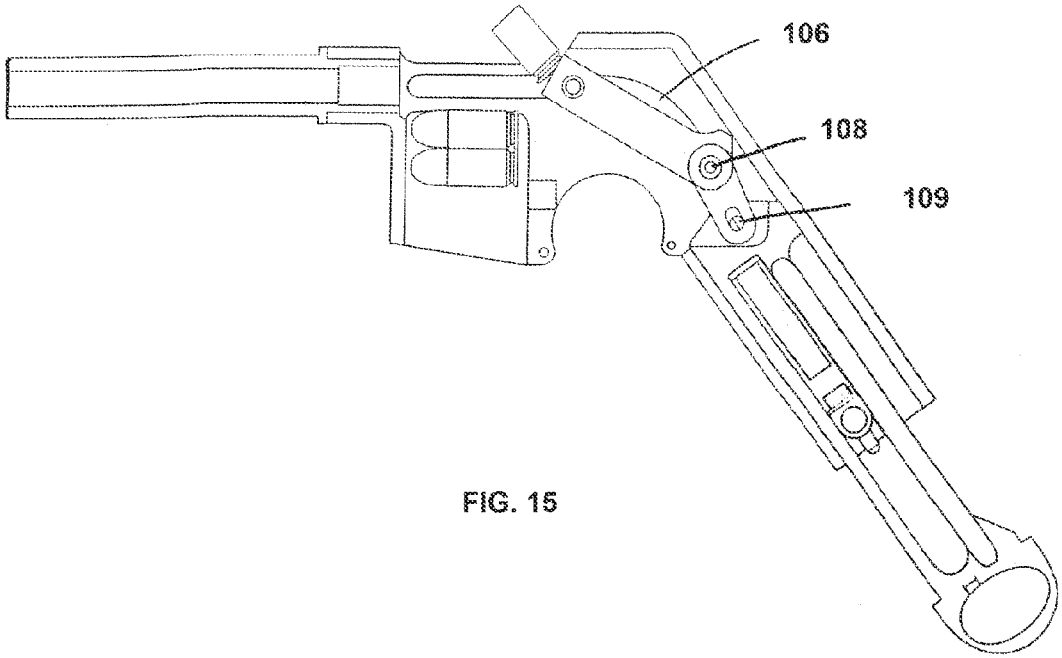

In FIG. 15, the mobile breech is back as far as it can go. The recovery mechanism (111), shown here as a return spring, has absorbed the maximum of recoil energy. The spent case is being ejected conventionally.

Figure 16:
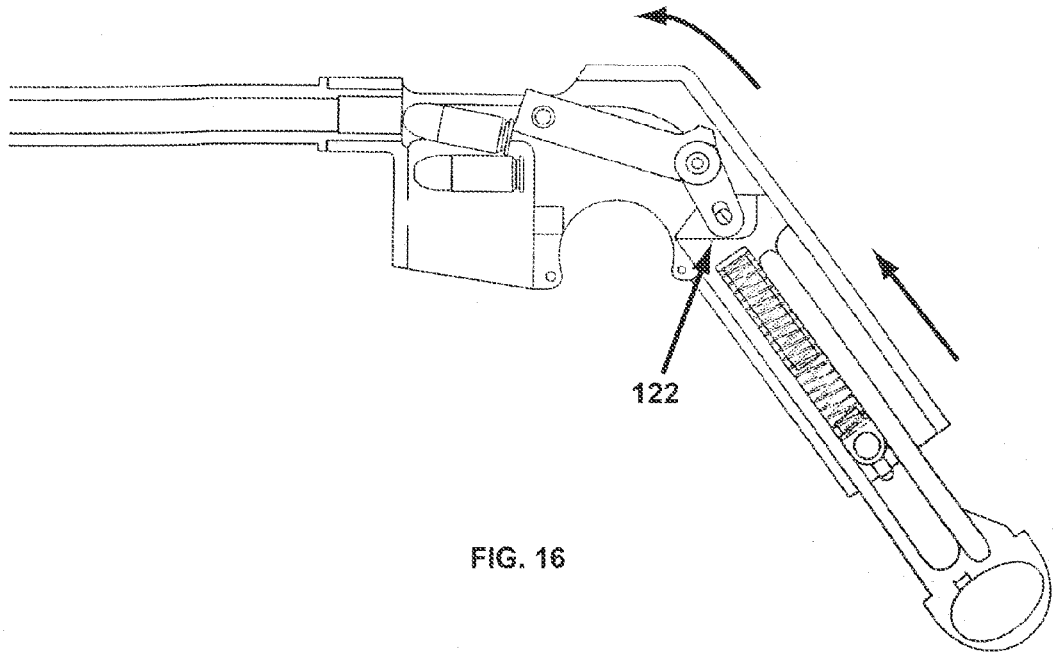

In FIG. 16, the case has been ejected and the mobile breech is returned forward by the return spring. Due to its shape and orientation, the pin rod (104) is thrust up against an edge (122) of the inertia block (102) and holds the mobile breech in extended position during this phase of its return. The bolt head (103) extracts a new round from the magazine in a manner familiar to those skilled in firearms technique.

Figure 17:
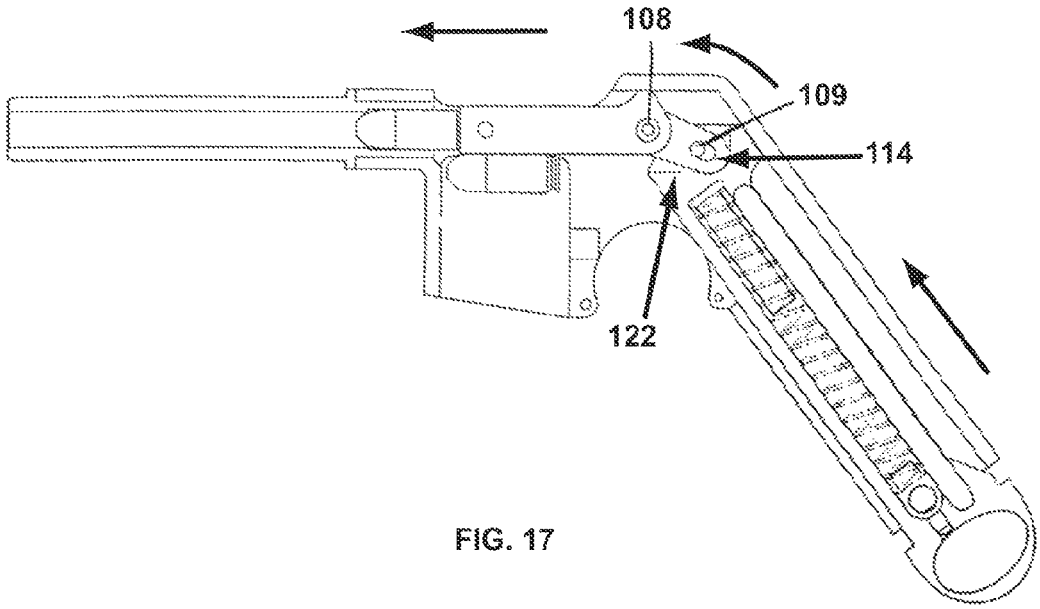

The mobile breech's movement forward continues as illustrated in FIG. 17. When the spindle (108) goes over the rounded top of the guidance ramp, the orientation of the pin rod (104) changes, so that it is freed from the edge (122) of the inertia block. The spindle (109) slides forward in the slot (114) and the mobile breech recovers its compact configuration while bringing another round in line with the barrel.

Figure 18:
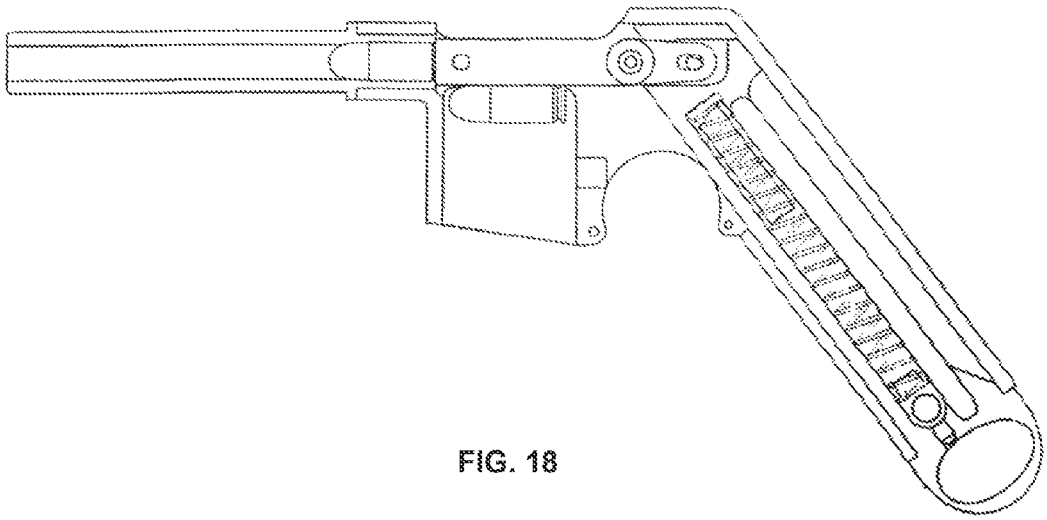

In passing from the stage shown in FIG. 17 to the phase shown in FIG. 18, the cartridge is chambered under pressure by the bolt head (103). It is in direct contact with the inertia block via sloped surfaces (P102 and P103), which slide over each other as the spindle (109) slides in the slot (114). The parts of the mobile breech have regained the configuration of FIG. 11.

in FIGS. 11 to 18, the moving parts act within a closed casing. The user is not in contact with critical moving parts, cocking lever or other components of the mechanism. This approach allows use of space normally neglected in pistols or in machine pistols having the magazine placed in front of the bridge, namely, the butt. The mechanism here described also enables reduction of the length of the bolt housing.

In yet another preferred embodiment, FIG. 19 shows the mobile breech, which comprises bolt head (103) and inertia block (102). The inertia block (102) is articulated with the bolt head (103) close to its rear extremity, preferably by a transverse spindle (109), which can take the form of a machined tenon on the bolt head projecting on either side. The bolt head has a second tenon (110), also projecting on both sides, in its foremost section that engages guide ramp (106) to guide the cyclic path of bolt head (103). The spindle (109) can slide within the oblique slot (208) housed in the anterior section of the inertia block (102). FIG. 19 displays the mobile breech in a position corresponding to the one at percussion: the spindle (109) is in the forward-down extremity of the slot (208). The slot (208) of the inertia block (102) has, one turned toward the other, two parallel lateral slopes (111 and 112) of the same pitch (P1), separated in order that the spindle (109) lodges with slight play in the direction of the gun barrel's axis. When the spindle slides in the slot (208), the bolt head (103) alternately makes contact with either the backward lateral slope (111) or the forward lateral slope (112) of the slot (208).

The inertia block (102) preferably has the form of a trapezoid. In a handgun or small caliber embodiment, the inertia block can be referred to as a sliding mechanism or a slider and these terms are used interchangeably herein. As shown in FIG. 19, the full length of the rear edge of inertia block (102) has a pair of lateral flanges (107) extending laterally from either side of the inertia block (102) and positioned to slide in the guidance grooves (105) of the breech block, as shown in FIG. 19. Guidance grooves (105) have a slope (P2), which presents an angle ($\beta$), shown in FIG. 20 and preferably set between 30 and 36 degrees in relation to the axis of the barrel. In the configuration shown in FIG. 22, the flange (107) also has a slope (P2) in relation to the axis of the barrel, which itself is horizontal. The flange (107) of the slope (P2) and the longitudinal axis of the slot (208), with slope (P1), present an angle ($\alpha$), which is preferably between 24 and 36 degrees.

The recoil energy recuperation mechanism is shown in FIG. 19 to the right of the inertia block (102). The recuperation mechanism includes a cocking lever (115) with a ring (114) to enable manipulation. The cocking lever (115) is hollow and forms a sleeve for the return spring (116). The spring (116) is turned around a rod (117). The cocking lever (115) slides over it in compressing or extending the return spring (116). The rod (117) is linked with the upper end of the breech block via ring (118) at fitting (150). A lug (119) on the cocking lever (115) manipulates the inertia block (102) conventionally. At the forward extremity of the Y (C1), a stud (151) is provided to anchor the trigger mechanism.

Figure 20:
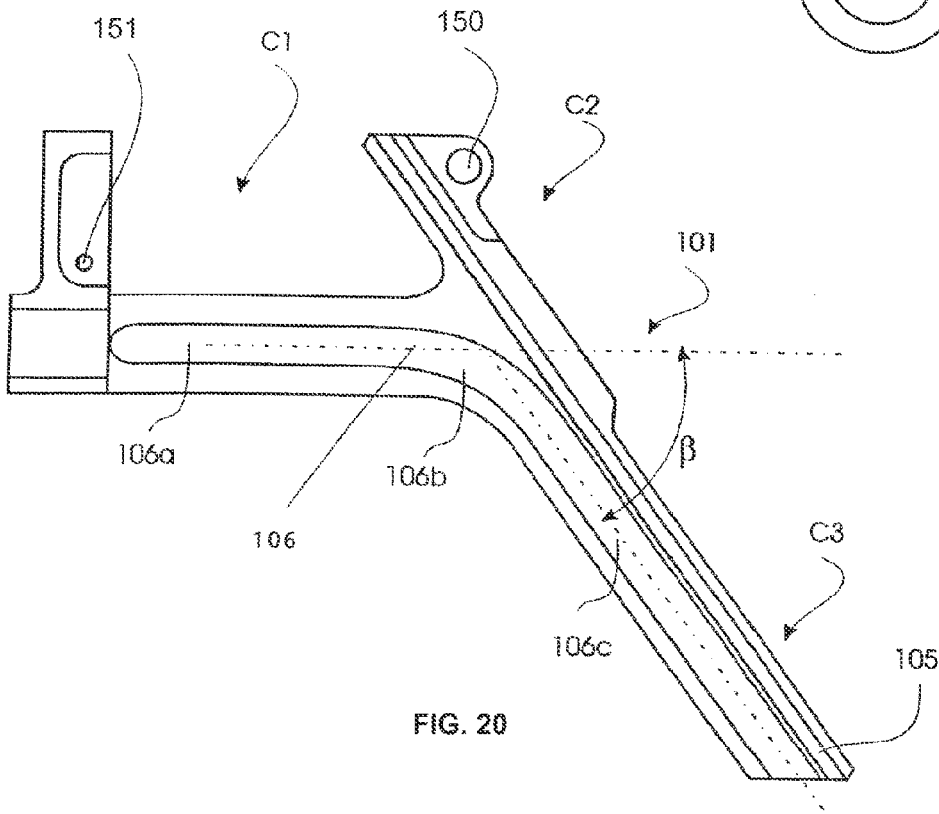
FIG. 20 is a longitudinal cutaway view of the housing or guide for the mobile breech showing the path of movement for the mobile breech shown in FIG. 19.

This mobile breech and recuperation mechanism operate within the breech block (101) as shown in cutaway in FIG. 20, its form preferably roughly that of the letter Y, having three arms, C1, C2, C3, and creating a guidance ramp (106) in roughly the form of the letter V.

FIG. 20 shows, on each side of the breech casing, a guidance ramp in the form of a "V" in a groove (106), which accommodates, respectively, the extremities of the spindle (109) which articulate the bolt head (103) with the inertia block (102), as well as the extremities of a tenon (110), which guides the forward end of bolt head (103). The head of the V of the guidance ramp (106) is rounded. The front arm C1 of the breech casing bears the forward section (106*a*) of the groove (106), which is arranged in the extension of the axis of the gun barrel, and the rear arm, C3, of the breech casing bears the rear section (106*c*) of the groove (106). Rear section (106*c*) features a slope (P2) in relation to the barrel's axis, which presents an angle (13) between the axis of the rear section (106*c*) and the axis of the barrel, preferably between 30 and 36 degrees. Each side of the breech block also features a groove (105), which is substantially parallel to the section at (106*c*) of the groove (106), and set to accommodate a flange (107) of the inertia block (102), which extends from section (C3) into the upper Y (C2) of the breech block.

In FIGS. 21 to 26 illustrate the functioning of a semiautomatic or automatic handgun equipped with the recoil control device shown in FIGS. 19 and 20. Sighting, percussion and ejection functions, are not shown in order to ease understanding of the recoil control device.

Figure 21:
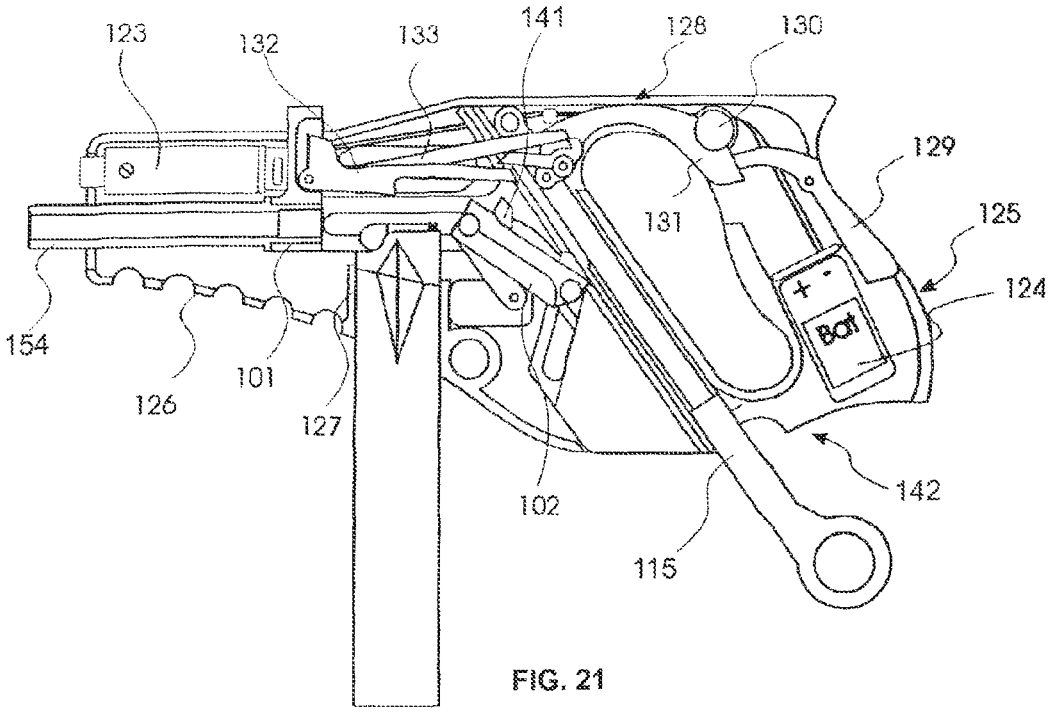
FIGS. 21-26 illustrate the action of a single-angled slider similar to the embodiment shown in FIGS. 19 and 20. Here, the firing mechanism is electrically powered.

The bolt head (103) preferably contains the percussion device. FIGS. 21 and 26 show the top of the hammer lug (141) projecting over the head of the bolt head (103). The technique governing the action of the hammer and its integration with the internal release are conventional. FIGS. 21 to 26 also show an optional infrared sighting device (123) mounted on the barrel and a battery (124) housed in the handgrip (125) to service it. The gun barrel (154) and the infrared sight (123) are contained within a sleeve for protection.

At its forward extremity, the breech block (101) supports the barrel (154). An ejection slot preferably is laterally placed and fitted with receptacles for a magazine below.

As shown in FIGS. 21 to 26, the breech block and the mobile breech are integrated into an exterior housing offering a minimum of exposed moving parts. The recoil energy recuperator is housed at the back of arms C2 and C3 of the breech block. A grip is located behind the recuperator that preferably is linked with the housing enclosing the breech block, both by lower arm (142), and upper arm (128). The grip (125) contains a safety lever (129) and the automatic or semi-automatic switch (130). The firing device (131) is preferably located in the part of the housing (128) that links the upper portion of the grip with the breech lock. The principal internal trigger (135) and the automatic internal firing release (132) are located in front of firing device (131) and are articulated at the upper extremity of the C1 arm of the breech block at stud (121). The functioning of these parts is conventional. Their placement in the overhead portion of the housing is specific to the embodiment of FIGS. 19-26.

In FIG. 21, the cocking lever (115) has been pulled. The inertia block (102) has been forced downward by the intervention of lug (119), causing the bolt head (103) to move backwards. The spindle (109) and the tenon (110) have moved into position respectively on either side of the round corner (106*b*) of the V groove (106). When the cocking lever (113) is pushed back, it forces the mobile breech forward by the lug (119). The bolt head (103) loads a round in the chamber in the usual way.

Figure 22:
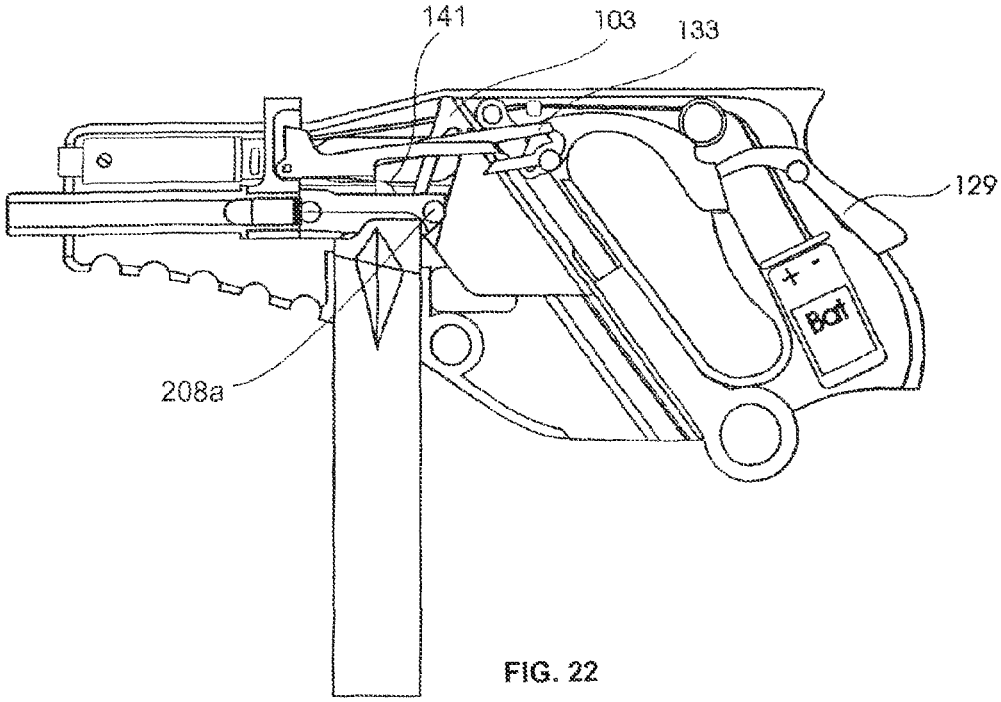

FIG. 22 shows the embodiment of FIG. 21 with the breech in closed position. A round is chambered. The bolt head (103) is in the pre-percussion position. Hammer lug (141) of the hammer is socketed in an indentation of the principal tumbler (133). The trigger can be actuated and the cartridge struck when the gun has been taken up and the safety catch is released. The inertia block (102) of the mobile breech is in a forward-up position, with at least an upper portion of the inertia block in position above the axis of the gun barrel. The transverse spindle (109) linking inertia block (102) and bolt head (103) is positioned in the forward-down (208*a*) portion of the oblong slot (208) of the inertia block (102), which houses it. In this configuration, the rear extremities of the bolt head (103) and the inertia block (102) are separated only by a slight margin of play.

Figure 23:
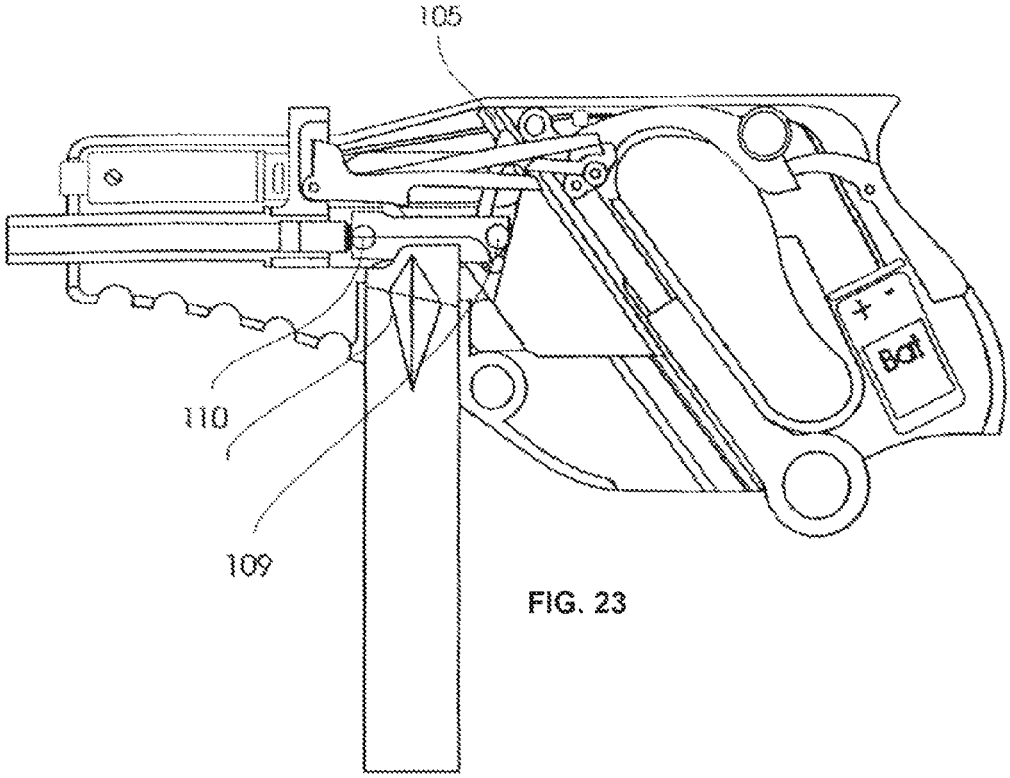

In FIG. 23, the cartridge has been struck, the bullet has exited the barrel (154) and the spent case starts backwards and forces back the bolt head (103). At the instant of its recoil, it strikes the inertia block (102), causing it to descend at high speed to the rear zone of the breech block cavity guided by grooves (105). The initial movement of the bolt head (103) is a translation backwards, tenons (109 and 110) being guided in the forward arm (106*a*) of the V of guidance ramp (106), while the movement of the inertia block (102) is a sloped translation (P2) towards the lower part of the gun, guided by rails (105). During the displacement, the spindle (109) slides in the slot (208) toward the rear-up extremity (208*b*) of slot (208).

The surface (111) of slot (208) and spindle (109) make contact momentarily, impulsively transferring the recoil forces and momentum from spindle (109) to inertia block (102) and then separate. The bolt head (103) is then pulled toward the back of the gun by the inertia block, to which it has transmitted the recoil energy, with spindle (109) sliding to side (112) of slot (208). The spent case is pulled backward in conventional ejection technique.

Figure 24:
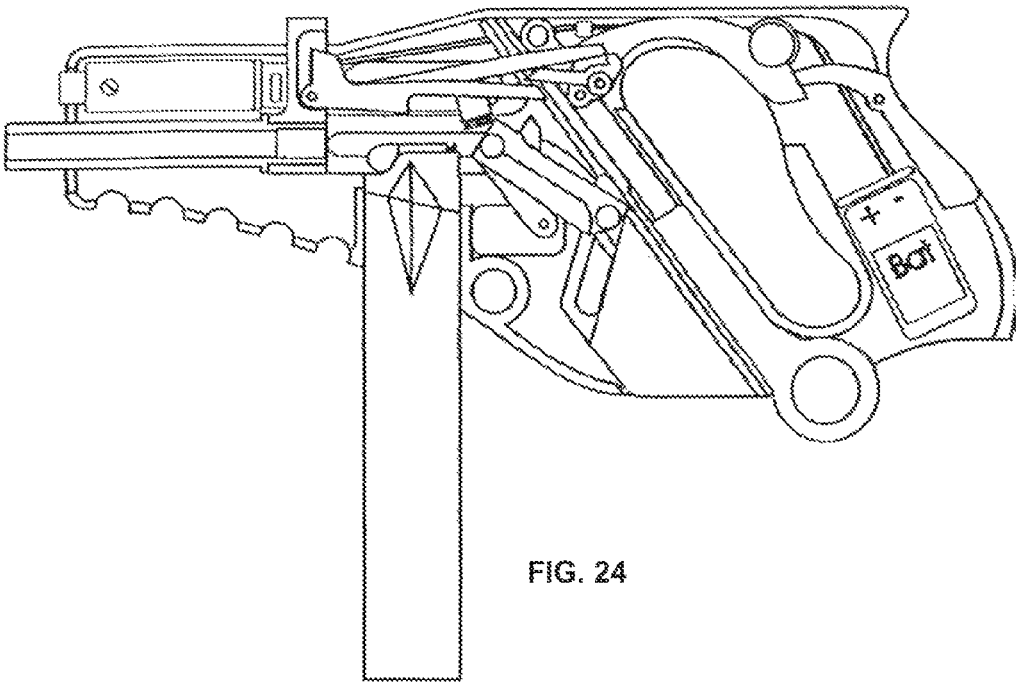

As the mobile breech pursues its displacement towards the back of the gun, the spindle (109) goes over the rounded top (106*b*) of the V of the ramp. The trajectory of the bolt head (103) curves toward the bottom of the gun.

in FIG. 24, the mobile breech has reached its final position at the hack of the weapon. The return spring (116) has absorbed the maximum energy generated as recoil. The spent case is being ejected in conventional action.

Figure 25:
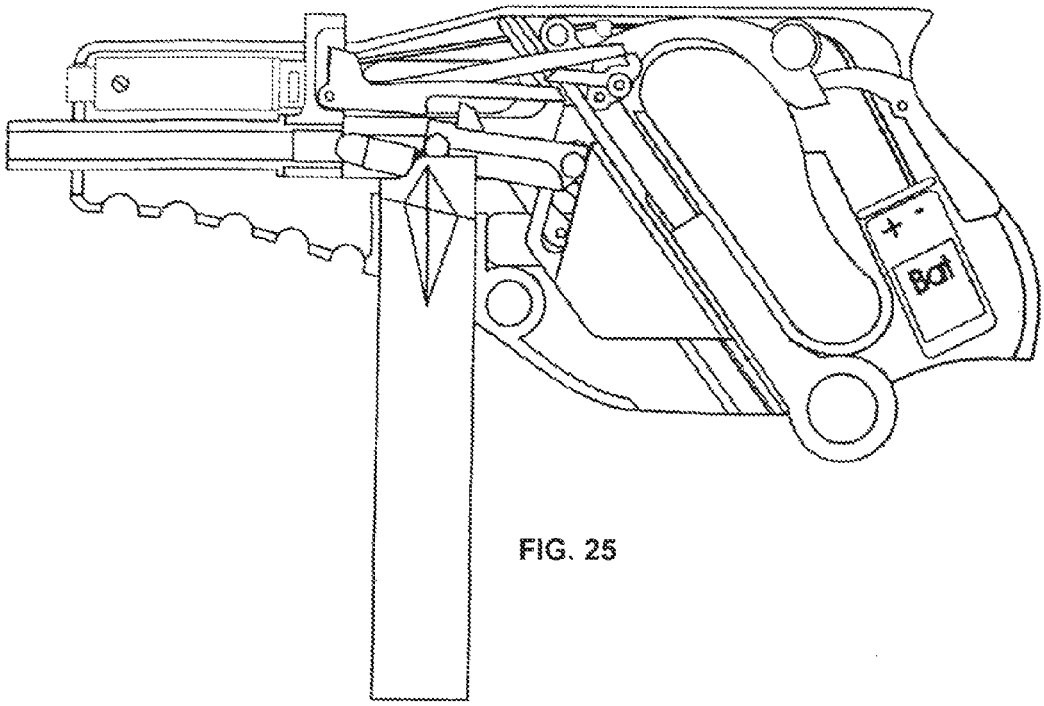
Figure 26:
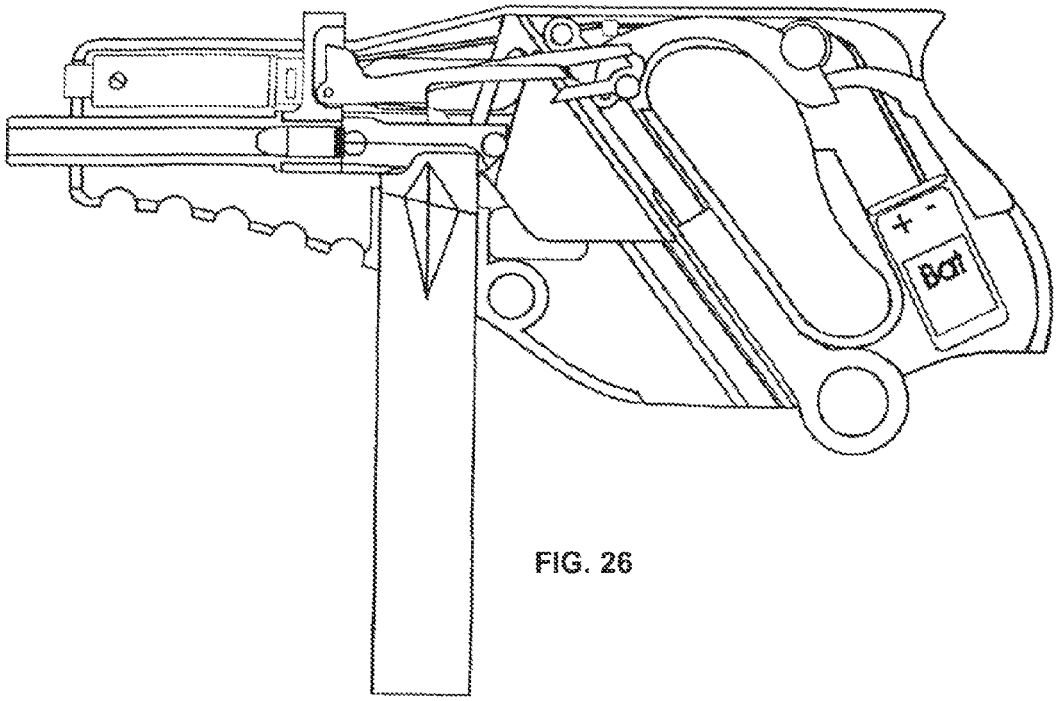

In FIG. 25, the spent case having been ejected, the inertia block (102) moves upward along groove (105) under the influence of the force of the return spring (116), ultimately returning the bolt to its initial pre-percussion position. When the spindle (109) reaches the rounded summit (106*b*) of the guide ramp, in the V, the orientation of the bolt head (103) alters to the horizontal. The bolt head (103) extracts a new cartridge from the magazine to feed the chamber in a conventional movement. During its displacement toward the front of the mobile breech, the spindle (109) slides in the slot (208) towards its forward-down limit (208*a*), pushed by the side of the slot (111).

Between the phase depicted in FIG. 25 and that shown in FIG. 26, the hammer is cocked and the new round is chambered under pressure exerted by the bolt head. The recoil control device regains the same configuration as that shown in FIG. 21. However, if the safety catch and the trigger are released, and the gun is set to fire in bursts, the following bullet fires automatically.

FIGS. 21 to 26 show that the assembly of moving parts is confined in closed housing. The user thus is not in contact with projecting, moving parts.

Figure 27:
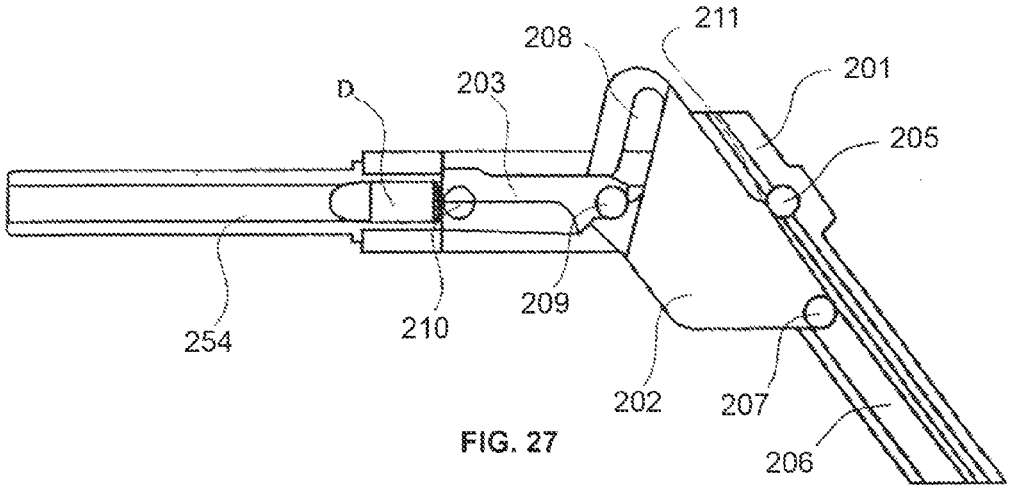
FIGS. 27-29 schematically show the mechanism of action of a recoil control device of the invention.
Figure 28:
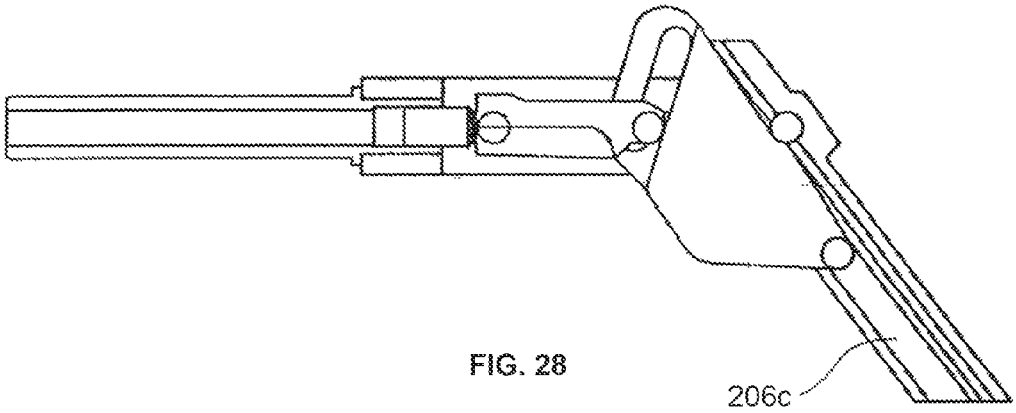
Figure 29:
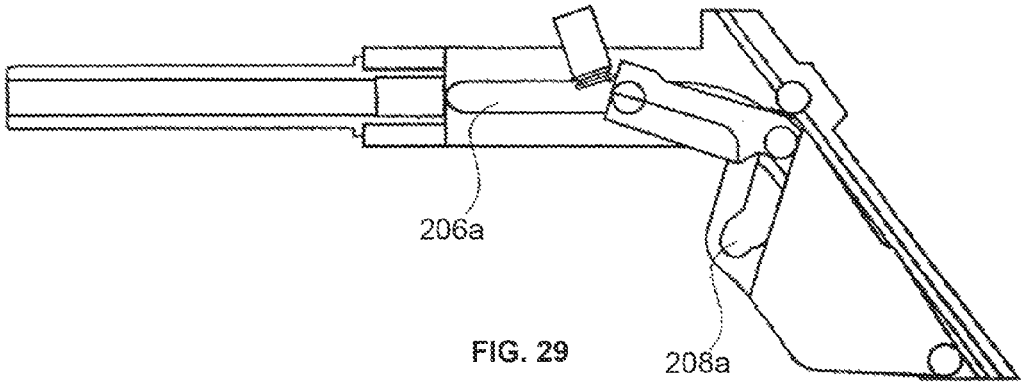
Figure 30:
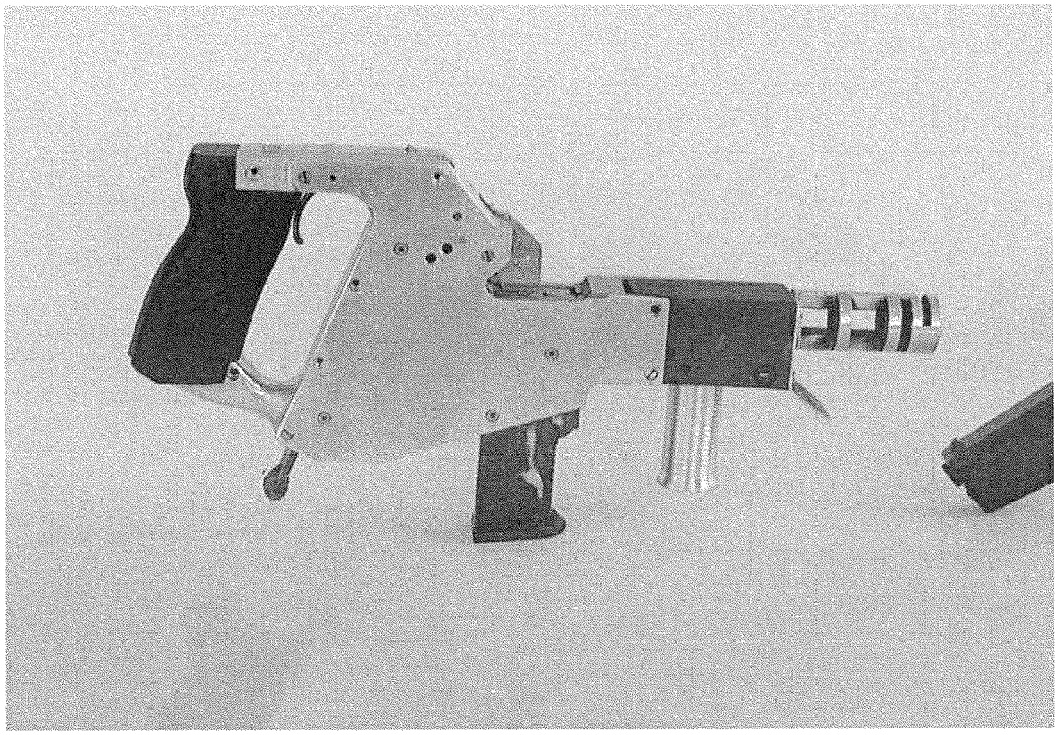
FIG. 30 is a photograph of an embodiment of the invention enclosed in a metal case.
Figure 31:
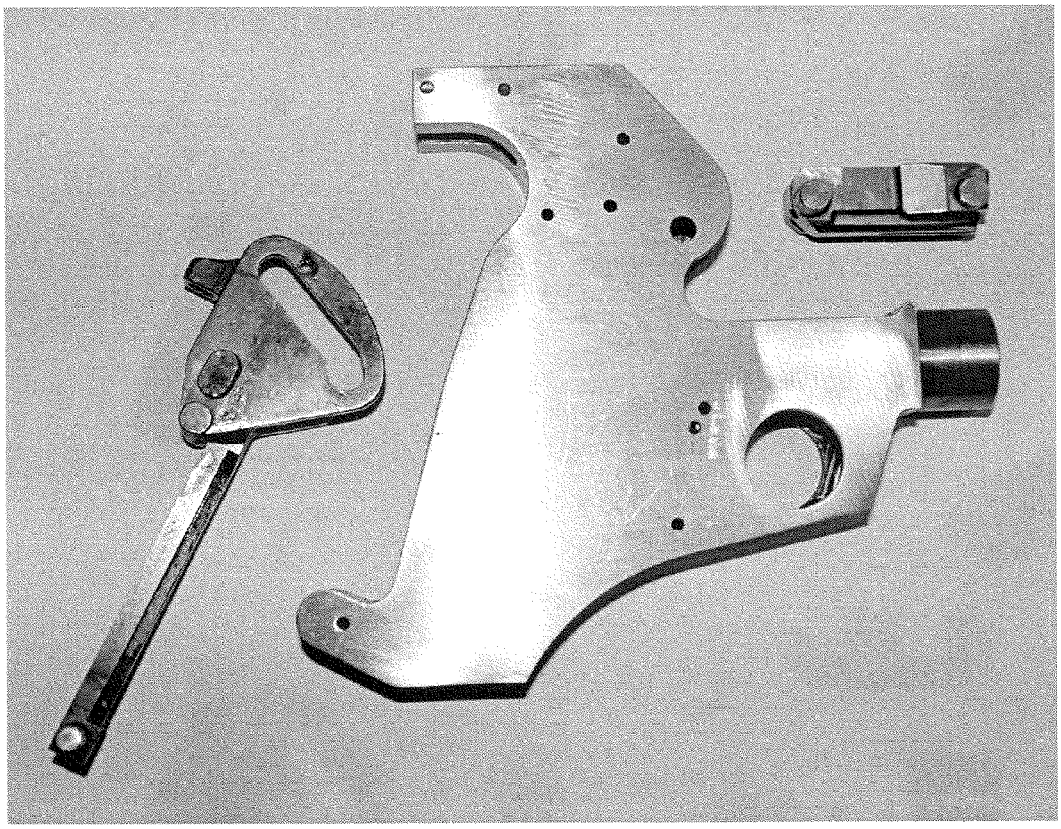
FIG. 31 is a photograph of a preferred embodiment of the invention comprising a slider with manual cocking lever (at left), a frame with integral guide or path for slider and bolt head (center), and bolt head (right). The protruding tenons or elements on slider and bolt head fit within the integral bolt head receiver element and slider guide element of the frame (not visible). The slot in slider also shows double-angle surface of slider that contacts bolt head. Tenon or element at end of bolt head fits within slot in slider. As noted in the description, the novel aspects of the invention allow easily manufactured parts such as these. Furthermore, the large size and robust character of the moving parts shown here allow for more reliable use, easier cleaning and maintenance of a firearm.

FIGS. 27, 28 and 29 illustrate a preferred embodiment of the moment control mechanism in which the movement of the slider is no longer one of pure translation but of translation to which is added an oscillation at the instant of recoil. With this treatment, the slider's movement exploits the same guide groove as the bolt head and a pressure roller located behind the slider.

As shown in FIG. 27, the gun has a breech block, (201), in inverted V form, which has a guide rail (206), also in V form in the mass of the side of the breech head. The bolt head (203) slides in the rail (206) by means of tenons (209) and (210), as in the embodiment of FIGS. 19-26. The bolt head (203) is articulated with slider (202) by tenon (209), which engages oblong slot (208) in the forward edge of the slider (203). The forward-down extremity of slot (208) has a skewed extension (208*a*) with a recess as shown in FIG. 32, In addition, a recess (211) is situated in the rear of the slider, which slides on a pressure roller (205). The recess (211) and the skewed extension (208*a*) of the slot are arranged to cooperate at the start and the finish of the firing cycle. The slider has a tenon (207), which slides in the lower portion (206*c*) of the guidance ramp (206). The guidance ramp (206) also accommodates tenons (209 and 210) of the bolt head in its horizontal portion (206*a*).

The functioning of this preferred embodiment for the recoil control device is by and large the same as that portrayed in FIGS. 19-26. This embodiment differs from the embodiment of FIGS. 19-26 in that at percussion the bolt head (203) presses the slider (202) between tenon (209) at the rear extremity of bolt head (203), and the pressure roller (205). The slider (202) is then expelled downward towards the bottom of the gun at a rate of displacement that is a function of the decoupling angles presented by the slopes of skewed extension (208*a*) and recess (211) on either side of the slider. Once the full rate of displacement of the slider (202) is achieved, it becomes the motor of the system and carries the bolt head to the rear with tenon (209) traveling in slot (208), the bolt head sliding in the segment (206*a*) of groove (206). At the start of its displacement towards the rear, the slider (202) tilts on its lug (207) in its lower section. On the other hand, an inverse oscillation by the slider at the end of its return has a dampening effect as the bolt head regains a closed configuration, its cartridge chambered.

The addition of the oscillation of the slider (202) to the overall movement of translation of the embodiment of FIGS. 19-26 enables greater adjustment of the resistance to the moment by means of an appropriate modification of the slider's decoupling angles, which present slopes that differ from the slope of groove (206).

The following Examples, and forgoing description, are intended to show merely optional configurations for the devices of the invention. Variations, modifications, and additional attachments can be made by one of skill in the art. Thus, the scope of the invention is not limited to any specific Example or any specific embodiment described herein. Furthermore, the claims are not limited to any particular embodiment shown or described here.

A series of exemplary .45 caliber machine pistols or handguns is produced, wherein the slider has a weight of between about 150 grams to about 175 grams, the bolt head has a weight of between about 50 grams to about 70 grams. The return device or recoil spring used has a 8.5 kg tare to about 11 kg tare.

One example employs a double-angle slider, similar to the embodiments of FIGS. 3-6 and incorporating one or more elements of the invention, and is presented with the following characteristics: length of barrel: approx 3-4 inches; initial angle of sloped surface of slider relative to barrel axis: 36 degrees or 44.5 degrees; weight of bolt head 52*g*; weight of inertia block 152 g; tare, recoil spring 8.4 kg. The operational characteristics give a theoretical firing rate: 950-1000 rounds/min.

Firing tests gave subjective impression of very smooth working part movement, with a noticeable reduction or quasi-total absence of the phenomenon of recoil. Additional testing with single rounds and eight round bursts (automatic action) also showed remarkable reduction of recoil with .45 caliber rounds and an elimination of upward jerking forces compared to a conventional .45 caliber handgun.

Another example incorporates the embodiments of FIGS. 7-8 and one or more elements of the invention and is presented by the following characteristics:

(i) Length of barrel: 603 mm
(ii) Total length: 978 mm
(iii) Weight (without magazine): 3.5 kg
(iv) System: gas and locked bolt
(v) Caliber: 7.62 NATO
(vi) Theoretical firing rate: up to 950 rounds/min A .45 caliber automatic machine gun is produced using a double-angled slider having a downward slider path similar to those shown in FIGS. 3-6. The weight of the bolt head is 56 g and the weight of the inertia block is 172 g.

The firearm was discharged in 5 round bursts and compared to the M3-3A1 automatic submachine gun ("grease gun") and a handheld Colt M1911 .45 caliber pistol. The upward jerking forces produce a noticeable and pronounced upward movement of the end of the barrel for the grease gun and pistol. In contrast, the firearm employing the device of the invention shows relatively little or no upward movement when handled and fired in similar circumstances.

One skilled in the art can devise and create numerous other examples according to this invention. Examples may also incorporate additional firearm elements known in the art, including muzzle brake, multiple barrels, blow sensor, barrel temperature probe, electronic firing control, mechanical firing control, electromagnetic firing control, and targeting system, for example. One skilled in the art is familiar with techniques and devices for incorporating the invention into a variety of firearm examples, with or without additional firearm elements know in the art, and designing firearms that take advantage of the improved force distribution and recoil reduction characteristics of the invention.

What is claimed is:

1. A firearm comprising:

a barrel defining the longitudinal axis of the barrel and having a forward end and a rearward end, where a cartridge is loaded at the rearward end;

a bolt head configured to alternate between a forward position and a rearward position in response to the firing of one or more cartridges; and a slider connected to the bolt head, the slider comprising a sloped surface to contact a linkage to the bolt head;

wherein the slider is positioned forward of or at the same position as the bolt head relative to the barrel when the bolt head rests at its forward position, and wherein the rearward movement of the bolt head forces the slider to move downward and below the longitudinal axis of the barrel upon firing.

2. The firearm of claim 1, wherein the sloped surface of the slider is comprised within a slot of the slider and the bolt head comprises a tenon, and wherein the tenon moves within the slot to force the downward movement of the slider.

3. The firearm of claim 2, wherein the slot contains contain a double-angled surface comprising at least two regions of the slot each having a surface with a different angle relative to the longitudinal axis of the barrel, and wherein the tenon contacts the at least two regions of the slot.

4. The firearm of claim 1, further comprising a bolt head guide arranged so that at least the initial backwards movement of the bolt head from the forward position occurs substantially along the axis of the gun barrel, and a slider guide arranged to guide the slider in a movement transverse to the longitudinal axis of the barrel.

5. The firearm of claim 4, wherein the slider guide comprises a sloped surface.

6. The firearm of claim 3, further comprising a bolt head guide arranged so that at least the initial backwards movement of the bolt head from the forward position occurs substantially along the axis of the gun barrel, and a slider guide arranged to guide the slider in a movement transverse to the longitudinal axis of the barrel.

7. The firearm of claim 6, wherein the slider guide comprises a sloped surface.

8. The firearm of claim 1, further comprising a housing, the housing comprising a forward extremity from which the barrel of the gun extends, a receptacle for a magazine, a forward section that accommodates the bolt head and the slider, and a rear section that accommodates the bolt head at its rearward position.

9. The firearm of claim 8,wherein the sides of the housing presents a guide rail for accommodating the movement of the slider.

10. The firearm of claim 9, wherein the guide rail forms a straight line.

11. The firearm of claim 9, wherein the guide rail forms a curved line.

* * * * *